US012320228B2

(12) United States Patent
Brint

(10) Patent No.: US 12,320,228 B2
(45) Date of Patent: Jun. 3, 2025

(54) END OF TUBING CARRIER TOOL AND METHOD FOR RELEASABLY SECURING SAME TO END OF A TUBULAR

(71) Applicant: Gary N. Brint, Katy, TX (US)

(72) Inventor: Gary N. Brint, Katy, TX (US)

( * ) Notice: Subject to any disclaimer, the term of this patent is extended or adjusted under 35 U.S.C. 154(b) by 0 days.

(21) Appl. No.: 18/862,700

(22) PCT Filed: Jul. 7, 2023

(86) PCT No.: PCT/US2023/027114
§ 371 (c)(1),
(2) Date: Nov. 4, 2024

(87) PCT Pub. No.: WO2024/015261
PCT Pub. Date: Jan. 18, 2024

(65) Prior Publication Data

US 2025/0116169 A1 Apr. 10, 2025

Related U.S. Application Data

(60) Provisional application No. 63/388,410, filed on Jul. 12, 2022.

(51) Int. Cl.
*E21B 33/129* (2006.01)
*E21B 43/10* (2006.01)

(52) U.S. Cl.
CPC ..... *E21B 33/129* (2013.01); *E21B 43/105* (2013.01)

(58) Field of Classification Search
CPC .. E21B 33/129; E21B 33/1291; E21B 43/105; E21B 43/103; E21B 43/108; E21B 23/01; E21B 43/10
See application file for complete search history.

(56) References Cited

U.S. PATENT DOCUMENTS 3,108,637 A * 10/1963 Lee ..... E21B 23/06 294/86.25
4,093,294 A * 6/1978 Taylor ..... E21B 31/20 294/94

(Continued)

FOREIGN PATENT DOCUMENTS

WO WO-2024015261 A1 * 1/2024

OTHER PUBLICATIONS

Taina Matos; International Search Report and Written Opinion for PCT/US2023/027114; Nov. 17, 2023; 11 pages; United States Patent and Trademark Office as the International Search Authority; Alexandria, VA.

*Primary Examiner* — Daniel P Stephenson
(74) *Attorney, Agent, or Firm* — James E. Hudson, III; Crain Caton & James P.C.

(57) ABSTRACT

An end of tubing carrier tool is provided for running through and attaching to the end of a tubular. The tool includes a body section, a lower collet on a distal portion of the body section. The lower collet includes lugs for contacting an exterior surface of the end of the tubular. A lower collet expander expands the lower collet. A mandrel section is arranged movably within and releasably lockable to the body section, and is configured to move the lower collet expander into engagement with the lower collet. Engagement of the lower collet expander with the lower collet moves the lugs of the lower collet radially outward to press against the exterior surface of the end of the tubular and releasably lock the end of tubing carrier tool at the end of the tubular.

27 Claims, 17 Drawing Sheets

(56) References Cited

U.S. PATENT DOCUMENTS

| | | | | |
|---|---|---|---|---|
| 4,363,358 | A * | 12/1982 | Ellis | E21B 23/042 166/212 |
| 6,003,607 | A | 12/1999 | Hagen et al. | |
| 7,866,390 | B2 * | 1/2011 | Latiolais, Jr. | E21B 33/05 166/70 |
| 9,556,695 | B2 * | 1/2017 | Jordy | E21B 33/10 |
| 2010/0101072 | A1 | 4/2010 | Cook et al. | |
| 2013/0087324 | A1 | 4/2013 | Moeller et al. | |
| 2014/0262260 | A1 | 9/2014 | Mayer et al. | |
| 2018/0106120 | A1 | 4/2018 | Harris et al. | |

* cited by examiner

END OF TUBING CARRIER TOOL AND METHOD FOR RELEASABLY SECURING SAME TO END OF A TUBULAR

CROSS REFERNCE TO RELATED APPLICATIONS

This application is an International Patent Cooperation Treaty (PCT) Application that claims priority to U.S. Provisional Patent Application No. 63/388,410, filed on Jul. 12, 2022, the entirety of which is incorporated by reference herein.

FIELD

The present disclosure relates to a through-tubing carrier tool, such as for carrying a sand control device that prevents sand from entering the production process, which is positionable at the end of a tubular and inside the casing of a wellbore. The tool may be releasably locked to the end of a tubular, subsequently unlocked, and then retrieved from the tubular. In particular, the present disclosure relates to an end of tubing carrier tool that can be positioned to protrude from the end of a tubular, locked in the protruding position, and then subsequently be releasably unlocked and retrieved from the tubular.

BACKGROUND

A problem with a majority of producing oil and gas wells is the unintended introduction of sand within the oil and gas flow. The sand impedes the oil and gas flow through the tubular, causes may surface related problems, and can damage the associated oil and gas producing equipment. Conventional processes used to block or stunt the introduction of sand have been costly endeavors. Oil and gas operators can spend hundreds of thousands of dollars per production zone on equipment that is designed to block or stunt sand from impeding the oil and gas flow. If that cost is higher than the monetary gains from many of the marginally producing oil and gas wells, production of the wells may cease even though there is likely more oil and gas available from the wells. Thus, a marginally producing well may be abandoned if the cost associated with sand removal and the damage caused to the production equipment is larger than the monetary benefit of oil and gas production from that well.

Conventionally, gravel packs have been used as a downhole filter to prevent the introduction of unwanted sand into the production process. The gravel packs hold gravel sand in place with a screen to block and prevent the sand from entering the flow lines. However, when gravel packs were first introduced as a possible solution they created more problems than the solved. Gravel packs have a tendency to plug up, which may lead to blowouts or holes occurring in the gravel pack with sand erosion. Additionally, gravel packs have a tendency in some cases to collapse.

Several other methods for preventing the unwanted introduction of sand into the production process have all been unsuccessful. Those methods continue to use conventional equipment and the results are costly and limited, as the accumulated sand builds up and hinders the flow often to a point where the oil and gas flow slows down to a trickle, or in some instances stops completely. Sand screens have proven to be an effective way to control the sand problem. However, the placement of the sand screen and the ability to access the sand screen or replace it has continued to be problematic with no successful solution.

There is thus a need for a device that enables a tool to be set and locked at the end of a tubular, and then be releasably unlocked, without running several pieces of equipment or using the other methods discussed above.

Embodiments of the end of tubing carrier tool and methods disclosed herein meet these needs.

SUMMARY

The present disclosure is directed to an end of tubing carrier tool that can be inserted into a tubular, positioned to protrude from the end of a tubular, be locked in the protruding position, and that can subsequently be releasably unlocked and retrieved from the tubular.

The end of tubing carrier tool is a multi-purpose device that may be utilized as a carrier tool for though-tubing sand control devices, such as a sand screen, which are positioned in the wellbore to be exposed to the casing while not contained inside the tubular. The end of tubing carrier tool may also be used with other equipment that can be located in the casing but outside of the tubular. For instance, the end of tubing carrier tool may be used in conjunction with downhole e pressure, temperature, and flow measuring devices. For sand control, a sand screen may be attached to a lower retrieving sub connected to the bottom of the end of tubing carrier tool. The lower retrieving sub hangs the sand screen in the annular portion of the casing to position the sand screen at a location to stop sand from flowing up into the tubular. The recovery sub may be connected to the bottom of the end of tubing carrier tool via shear pins to ensure that if the sand screen is stuck in the casing, e.g., with accumulated sand covering and clogging the sand screen, the end of tubing carrier tool can be recovered from the tubular by breaking the shear pins to separate the sand screen from the end of tubing carrier tool.

Generally, the end of tubing carrier tool during the locating and setting operations is designed to be inserted into a tubular with a tool string designed for the end of tubing carrier tool until the lower end of the end of tubing carrier tool exits the end of the tubing. The end of tubing carrier tool is then picked back up into the tubular via an upward motion until a bottom locating collet of the tool locates at an exterior surface of the end of the tubular. The upward motion is applied with an appropriate force above the total tool weight in order to move an internal mandrel section of the end of tubing carrier tool upwards within the confines of a corresponding body section. This upward motion presses locking slips riding on the outer sides of the mandrel section and within the body section to engage against the inner surface of the tubular wall to anchor and releasably lock the end of tubing carrier tool at the end of the tubular for completing the locating and setting operations, and allowing for the production process to begin. When a production process is completed, the end of tubing carrier tool may be released from its anchored position by a downward jarring motion with a recovery tool that shears a breakable element holding the mandrel section to the body section. Such separation releases the engagement of the locking slips with the tubular, so that the end of tubing carrier tool may be withdrawn from the tubular.

In an embodiment, an end of tubing carrier tool for running through and attaching to the end of a tubular comprises: a body section; a lower collet on a distal portion of the body section, the lower collet including lugs for contacting an exterior surface of the end of the tubular; a lower collet expander for expanding the lower collet; and a mandrel section arranged movably within and releasably lockable to the body section, and configured to move the lower collet expander into engagement with the lower collet, wherein engagement of the lower collet expander with the lower collet moves the lugs of the lower collet radially outward to press against the exterior surface of the end of the tubular and releasably lock the end of tubing carrier tool at the end of the tubular.

In an embodiment, wherein each of the lugs comprises: an angled outside surface at a tip of each lug to guide the end of tubing carrier tool into the tubular, and a shoulder to locate the exterior surface of the end of the tubular and sit on the exterior surface when the end of tubing carrier tool is set at the end of the tubular, wherein the shoulder is angled to guide the end of tubing carrier tool up the tubular.

In an embodiment, the lower collet comprises a plurality of prongs, wherein a distal end of each prong includes one of the lugs, and wherein the plurality of prongs is configured to flex radially inward or outward when the mandrel section moves relative to the body section and the collet expander engages or disengages the lugs.

In an embodiment, wherein each of the lugs comprises an inner indentation that contacts a corresponding outer indentation on the lower collet expander, and the inner indentation and the outer indentation each comprises a contact surface that is perpendicular to a longitudinal axis of the end of tubing carrier tool.

In an embodiment, the lower collet expander comprises a plurality of axial extensions, each axial extension includes a hook portion at a distal end thereof, and the hook portion includes first contact surface.

In an embodiment, the end of tubing carrier tool further comprises a cross over sub for engaging with the lower collet expander via movement of the mandrel section, wherein the cross over sub is attached to the distal end of the mandrel section and comprises a protruding lip having a second contact surface that engages with the first contact surface of the hook portion when the mandrel section moves relative to the body section, and wherein the first contact surface and the second contact surface are at an angle other than 90 degrees relative to a longitudinal axis of the end of tubing carrier tool.

In an embodiment, the end of tubing carrier tool further comprises a shear ring on a proximal portion of the body section, wherein the shear ring is releasably attachable to the mandrel section via movement of the mandrel section relative to the body section, and wherein engagement of the mandrel section with the shear ring releasably locks the mandrel section to the body section.

In an embodiment, an inner surface of the shear ring comprises a latch-and-lock mechanism, and comprises a longitudinal gap in a wall of the shear ring.

In an embodiment, the body section further includes a plurality of openings spaced circumferentially from each other, and the end of tubing carrier tool further comprises: a locking slip positioned at each one of the plurality of openings, wherein the mandrel section includes a protruding portion for engaging the locking slips, and each of the locking slips comprises at least one radially extending protrusion that extends through a respective one of the plurality of openings upon engagement of the protruding portion against the locking slips when the mandrel section moves relative to the body section, to press the at least one radially extending protrusion against an inner surface of the tubular to releasably lock the end of tubing carrier tool to the tubular.

In an embodiment, the body section further includes; at least one mandrel locking ring for gripping a portion of the mandrel section to releasably lock the mandrel section to the body section; and a biasing device for actuating the mandrel locking ring.

In an embodiment, the mandrel locking ring comprises a c ring positioned between two pressure rings that transmit a compression force from the biasing device to the c-shaped ring, and a diameter of the c-shaped ring decreases or increases via the compression force so that the c-shaped ring grips the portion of the mandrel section when the diameter decreases and grips a portion of the body section when the diameter increases.

In an embodiment, the c-shaped ring comprises at least one of: an inner surface that faces the portion of the mandrel section, and the inner surface comprises a plurality of axially extending recesses; and an outer surface that faces the body section, and the outer surface comprises a plurality of axially extending recesses.

In an embodiment, the end of tubing carrier tool further comprises a flow sub coupled to the cross over sub; and a flow collet slidable within the flow sub and comprising a sealing portion, wherein the flow sub comprises a fluid flow port, and the sealing portion is configured to close the fluid flow port when the flow collet slides within the flow sub.

In an embodiment, at least one of the flow sub and the flow collet includes shear pins for attaching the end of tubing carrier tool to a running tool that runs the end of tubing carrier tool into the tubular and to the exterior surface of the bottom end of the tubular.

In an embodiment, the end of tubing carrier tool further comprises a lower internal retrieving attachment for attaching to a downhole tool, wherein the lower internal retrieving attachment is releasably coupled to the a distal end of the flow sub.

In another embodiment, a method for releasably locking an end of tubing carrier tool to an end of a tubular is provided. The method comprises inserting, in a first direction, the end of tubing carrier tool through the tubular so that at least a lower collet and a lower collet expander of the end of tubing carrier tool protrude out of the tubular and beyond the end, the lower collet including lugs; and moving a mandrel section of the end of tubing carrier tool in a second direction that is opposite to the first direction to bring the lower collet expander into engagement with the lower collet to move the lugs of the lower collet radially outward to press against an exterior surface of the end of the tubular and releasably lock the end of tubing carrier tool at the end of the tubular.

In an embodiment, moving the mandrel section in the second direction releasably locks the mandrel section to a body section of the end of tubing carrier tool by engaging an outer portion of the mandrel section with an inner portion of a shear ring on the body section, wherein engagement of the mandrel section with the shear ring prevents further movement of the mandrel section in the second direction.

In an embodiment, moving the mandrel section in the second direction causes a biasing device of the body section to be compressed and exert a force against an upper sub adjacent the shear ring and on a mandrel locking ring, wherein the force: reduces a diameter of the mandrel locking ring so that the mandrel locking ring grips a portion of the mandrel section to releasably lock the mandrel section to a body section; or increases a diameter of the mandrel locking ring so that the mandrel locking ring grips a portion of the body section to releasably lock the mandrel section to the body section.

In an embodiment, moving the mandrel section in the second direction causes a protruding portion of the mandrel section to engage and move one or more locking slips of the body section through a plurality of corresponding openings in the body section so that at least one radially extending protrusion on each of the one or more locking slips is pressed outward against an inner surface of the tubular to releasably lock the end of tubing carrier tool to an inside surface of the tubular.

In an embodiment, the mandrel section is moved in the second direction via a running tool arranged inside of the mandrel section and releasably attached to the end of tubing carrier tool via one or more shear devices, and the running tool is detached from the end of tubing carrier tool via a force that breaks the one or more shear devices allowing for the running tool to be removed from the tubular.

In an embodiment, the end of tubing carrier tool comprises a flow collet contained within a flow sub that includes a fluid flow port, the running tool is detachably attached to the flow collet by means of one or more shear devices, and continued movement in the second direction moves the flow collet relative to the flow sub to close the fluid flow ports, and wherein further movement in the second direction breaks the one or more shear devices to release the attachment of the running tool to the flow collet.

In an embodiment, the method further comprises producing a force via a retrieving tool on the end of tubing carrier tool in the first direction and/or the second direction to break the engagement between the shear ring and the mandrel section and cause the mandrel section to move relative to the body section in the first direction, wherein movement of the mandrel section relative to the body section in the first direction disengages the collet expander from the lower collet, which allows the lugs of the lower collet to flex radially inward and move out of contact with the exterior surface of the end of the tubular.

In an embodiment, the force on the end of tubing carrier tool in the first direction or the second direction breaks one or more shear devices attaching a lower internal retrieving attachment to a flow sub, the lower internal retrieving attachment for attaching to a downhole tool.

In an embodiment, movement of the mandrel section to move relative to the body section in the first direction causes the protruding portion of the mandrel section to disengage from the one or more locking slips so that the at least one radially extending protrusion of each locking slip is released from being pressed against the inner surface of the tubular.

In an embodiment, movement of the mandrel section to move relative to the body section in the first direction removes the force of the biasing device on the mandrel locking ring to further allow the diameter of the mandrel locking ring to one of: increase and un-grip from the mandrel section; and decrease and un-grip from the body section.

In an embodiment, the method further comprises withdrawing the end of tubing carrier tool from the tubular in the second direction.

In a further embodiment, a system for releasably locking an end of tubing carrier tool to an end of a tubular comprises an end of tubing carrier tool for insertion into the tubular, the end of tubing carrier tool configured to be releasably locked to an exterior surface of the end of the tubular; a running tool for running the end of tubing carrier tool into the tubular and releasably attaching the end of tubing carrier tool to the exterior surface of the end of the tubular, the running tool configured to be releasably attached to the end of tubing carrier tool; a first jarring tool for attaching to the running tool and for producing a jarring force to release the attachment of the running tool with the end of tubing carrier tool, and for withdrawing the running tool from the tubular; a retrieving tool for releasably attaching to the an end of tubing carrier tool at the exterior surface of the end of the tubular; and a second jarring tool for attaching to the retrieving tool and for producing a jarring force to release the attachment of the end of tubing carrier tool from the exterior surface of the end of the tubular.

The foregoing is intended to give a general idea of the embodiments, and is not intended to fully define nor limit the invention. The embodiments will be more fully understood and better appreciated by reference to the following description and drawings.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower" "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Furthermore, it will be understood that all parts of the end of tubing carrier tool 10 may be formed of materials that are selected based upon the variable conditions found present at each well site, are not limited in any wat to all know materials, and may also include the development of new materials and properties such as through heating treatments and quenching techniques. All material(s) used in the end of tubing carrier tool, including all of the component pieces and component parts may be formed of any suitable material including, but not limited to: metal alloys, metal super alloys, combinations of metal alloys, steel, graded steel, maraging steel, graphite, graphene, carbon, carbon fibers, carbon composites, plastics, poly plastics, elastomers, ceramic, silicon, titanium, tungsten, chromium, and other known materials. The material(s) may be selected depending on the type of well fluids and gasses present at a well site at which the end of tubing carrier tool may be used, as well as the temperature and pressure found present during well drilling, production, and when the well is such in. The material selected and used does not in any way change the spirit of the invention and the way in which the end of tubing carrier tool is tended to operate.

Figure 1A:
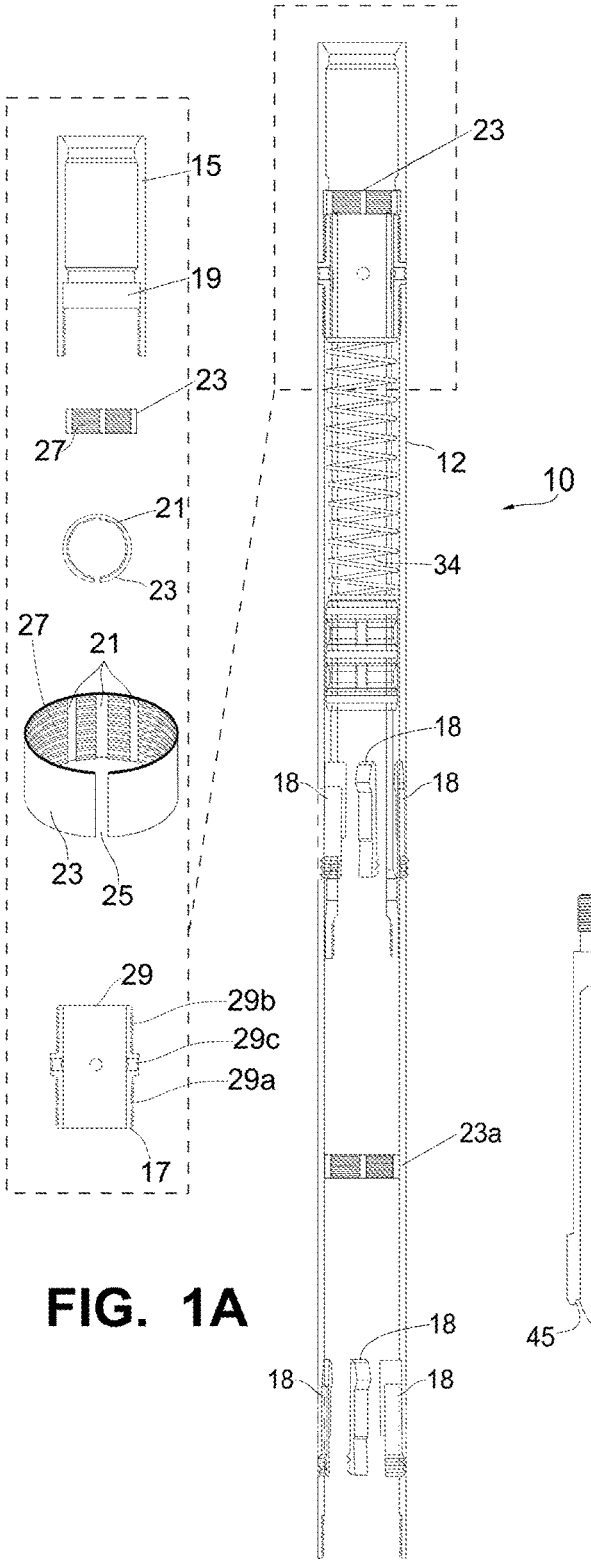
FIGS. 1A and 1B illustrate a cross-sectional exploded view of a body section and associated parts of an end of tubing carrier tool according to an embodiment.
Figure 1B:
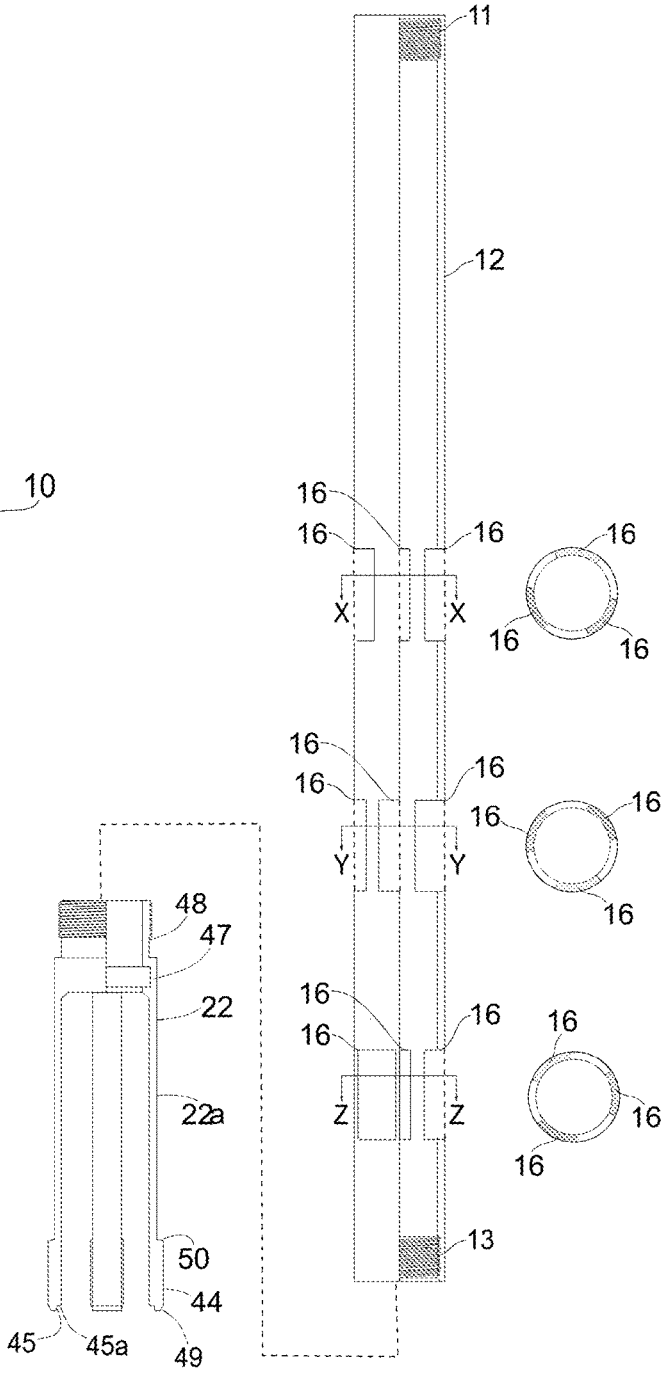

An end of tubing carrier tool 10 is described herein by first discussing its component parts. FIG. 1A shows internal component pieces of a body section 12 of the end of tubing carrier tool 10. The body section 12 may have a shape that is cylindrical or substantially cylindrical along the longitudinal axis of the tool, FIG. 1B shows that the body section 12 includes one or more sets of openings 16 that form openings in the exterior wall of the body section 12. Each set of openings 16 may include three openings 16 circumferentially spaced from each other around a perimeter of the body section 12. FIGS. 1A and 1B show three sets of openings 16, wherein the sets are spaced axially along the axis of the body section 12. Further, the openings 16 in each set may be circumferentially offset, or out of phase, from the openings 16 in another set, as shown in FIG. 1B. Each of the circles in FIG. 1B represents a cross-section of the body section 12 at a location along lines x-x, y-y, and z-z, respectively. The shaded areas of each circle indicate a circumferential location of openings 16. Each of the openings 16 is configured to contain therein a locking slip 18, shown in FIGS. 1A and 3B. The function of the locking slips 18 is discussed below.

The proximal end 11 of the body section 12 may include threads for attaching to an upper sub 29 that intervenes between the proximal end 11 and a recovery attachment referred to as a recovery sub 15. That is, the upper sub 29 may include a lower set of threads 29*a* for engaging with the threaded proximal end 11 of the body section 12, and may also include an upper set of threads 29*b* for engaging with a threaded part 15*a* of the recovery sub 15. The upper sub 29 may further include a wrench grip 29*c*, or series of wrench grips 29*c*, between the lower set of threads 29*a* and the upper set of threads 29*b*. The wrench grip 29*c* is utilized to turn the upper sub 29 for loosening or tightening with respect to the proximal end 11 of the body section 12 and/or the recovery sub 15. In alternative embodiments, the recovery sub 15 may be attached to the proximal end 11 of the body section 12 via another attachment means, such as screws. A lower portion of the upper sub 29 includes a shoulder 17 for engaging with the end of a biasing device 34 discussed below. In one embodiment, a buffering device (not shown) may be provided between the biasing device 34 and the shoulder 17.

Figure 2:
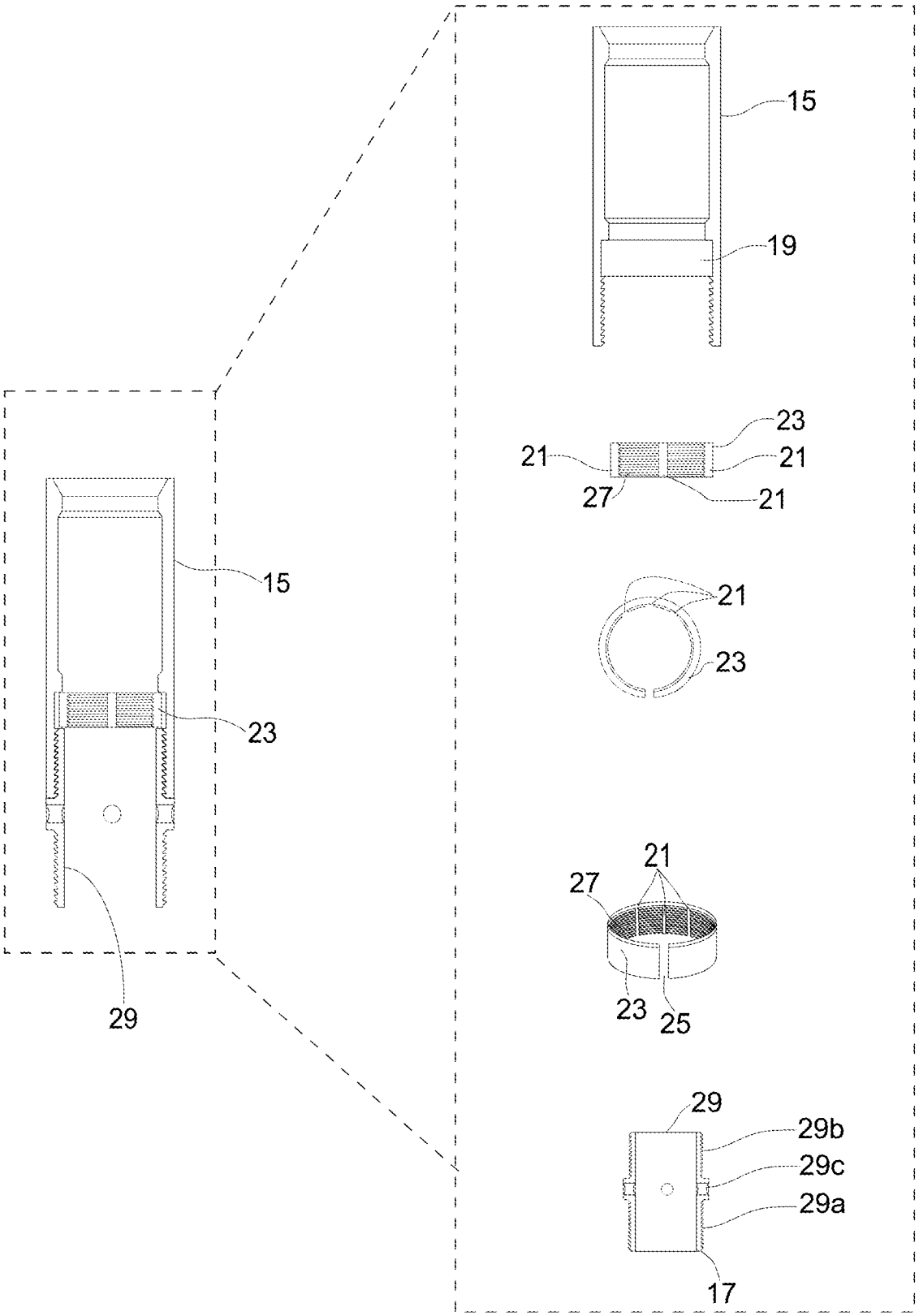
FIG. 2 illustrates a cross-sectional exploded view of the top part of the body section according to an embodiment.

Another part of the recovery sub 15 includes a space 19 for accommodating a shear ring 23. The shear ring 23 may include a gap 25 in the wall of the shear ring 23 as shown in FIG. 1A and FIG. 2. The inner surface of the shear ring 23 may include a latch-and-lock mechanism 27 that is configured to engage with corresponding threads of a mandrel section 14 (see FIGS. 3A and 3B), discussed below. In one embodiment, the latch-and-lock mechanism 27 may be buttress threads or sections of buttress threads that are separated circumferentially from each other via longitudinal recesses 21 on inner surface of the shear ring 23. Accordingly, the shear ring 23 attaches to the proximal end of the mandrel section 14 via the buttress threads. In another embodiment, the latch-and-lock mechanism 27 may be a knurled section on the surface of the shear ring 23. The knurled section may grip the corresponding threaded surface of the mandrel section 14 to releasably attach the shear ring 23 to the mandrel section 14. In further embodiments, the latch-and-lock mechanism 27 may be any other type of releasable fastener on the inner surface of the shear ring 23 to releasably attach the shear ring 23 to a threaded surface of the mandrel section 14. The particular type of latch-and-lock mechanism 27 may be selected based on the size of the end of tubing carrier tool 10 and/or the equipment with which the end of tubing carrier tool 10 is used, e.g., the downhole tool attached to the end of tubing carrier tool 10. FIG. 1A shows that the shear ring 23 is unattached to the mandrel section 14, which is the state of the shear ring 23 before the setting operation is performed and the end of tubing carrier tool 10 is set on the end 102 of a tubular 100 as discussed below. The force of the biasing device 34 stops the mandrel section 14 from prematurely latching with the latch-and-lock mechanism 27 of the shear ring 23 during running of the end of tubing carrier tool 10 through the tubular 100 if encountering a fluid level that may suddenly inhibit further running of the end of tubing carrier tool 10. A second shear ring 23*a* may be provided in the body section 12 between sets of locking slips 18 as shown in FIG. 1A, and may have the same function as shear ring 23 and serve as a back up to shear ring 23.

The distal end 13 of the body section 12 may include threads for attaching a lower collet 22 to the distal end 13. In such an embodiment, the lower collet 22 includes corresponding threads for engaging with the threads at the distal end 13 of the body section 12. An upper portion of the lower collet 22 includes an inner seal area 47 at an inner circumference of the lower collet 22 for locating a seal 47*a*, such as a sealing ring, or packing (see FIG. 7). The inner seal area 47 may be located below the threads of the lower collet 22. The seal 47*a* is configured to seal against the mandrel section 14 when the mandrel section 14 is inserted into the body section 12 (see FIG. 7). In one embodiment, the seal 47*a* may be formed of leather or an elastic material. The upper portion of the lower collet 22 also includes an outer seal area 48 at an outer circumference of the lower collet 22 for locating a seal 48*a*, such as a sealing ring, or packing (see FIG. 7). The outer seal area 48 may be located adjacent the threads of the lower collet 22 as shown in FIG. 1B. The seal 48*a* is configured to seal against the tubular when the end of tubing carrier tool 10 is inserted into the tubular (see FIGS. 9A, 10A and 13). In one embodiment, the seal 48*a* may be formed of leather or an elastic material. Neither of the seals 47*a*, 48*a* is intended to hold pressure. Rather, the seals 47*a*, 48*a* are designed to keep fluid containing sand from entering the tubular. For instance, the seals 47*a*, 48*a* may force all well fluid through a sand screen attached to a distal end of the end of tubing carrier tool 10.

The end of the lower collet 22 opposite the end having the threads includes two or more prongs 22*a* having a lug 44 at the end thereof. In a preferred embodiment, the lower collet 22 includes three prongs 22*a* spaced circumferentially from each other. In another embodiment, the lower collet 22 includes four prongs 22*a* spaced circumferentially from each other. In a further embodiment, the lower collet 22 includes an odd number of prongs 22*a*, such as five or seven prongs 22*a*, spaced circumferentially from each other. Each of the lugs 44 includes an inner indentation 45 as shown in FIG. 1B. The inner indentation 45 comprises a contact surface 45*a* that is perpendicular to the longitudinal axis of the body section 12 and of the end of tubing carrier tool 10, In a preferred embodiment, the distal tip of the lugs 44 includes an outside surface 49 that is slanted at an angle of about 45 degrees relative to the axis of the body section 12 and of the end of tubing carrier tool 10. The 45 degree angle is preferred, but other angles close to 45 degrees are encompassed within the scope of this disclosure. For instance, the outside surface 49 may have an angle between 30 degrees and 60 degrees. The slanted outside surface 49 helps guide the assembled end of tubing carrier tool 10 into the opening end of a tubular 100. The proximal end of the lugs 44 includes a shoulder 50 for abutting against an exterior surface of the end 102 of the tubular 100 when the end of tubing carrier tool 10 is set and locked into position on the tubular 100. The shoulder 50 may be slanted relative to the axis of the body section 12 and the end of tubing carrier tool 10 at an angle of 5 to 15 degrees. In a preferred embodiment, the angle of the shoulder 50 is 5 to 7 degrees. Operators may use this angle as a guide mechanism for easier withdrawal out of the tubular 100, In a preferred embodiment the axial length of each lug 44 is about 2 inches of a 2 and ⅜ inch tubular, but the length is not limited thereto. The prongs 22*a* are relatively flexible, such that they may be moved radially inward and outward relative to the upper end of the lower collet 22. The prongs 22*a* are slightly angled radially outward from the upper end of the lower collet 22. The lugs 44 are configured to be pressed radially outward via engagement with a lower collet expander 28, as discussed below.

Figure 3A:
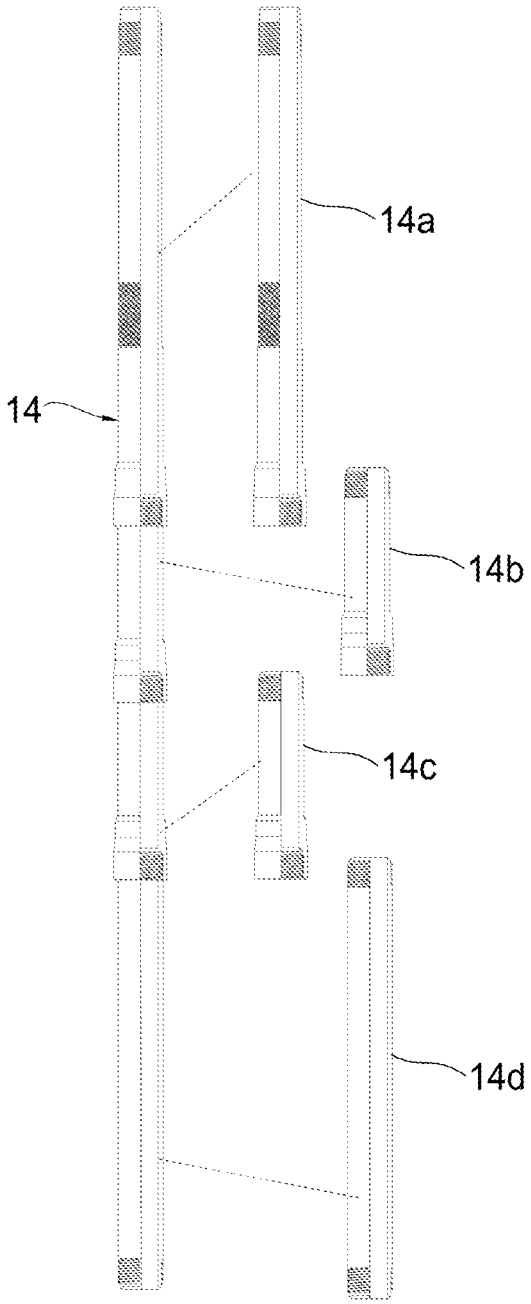
FIGS. 3A and 3B illustrate a cross-sectional exploded view of a mandrel section and associated parts of an end of tubing carrier tool according to an embodiment.
Figure 3B:
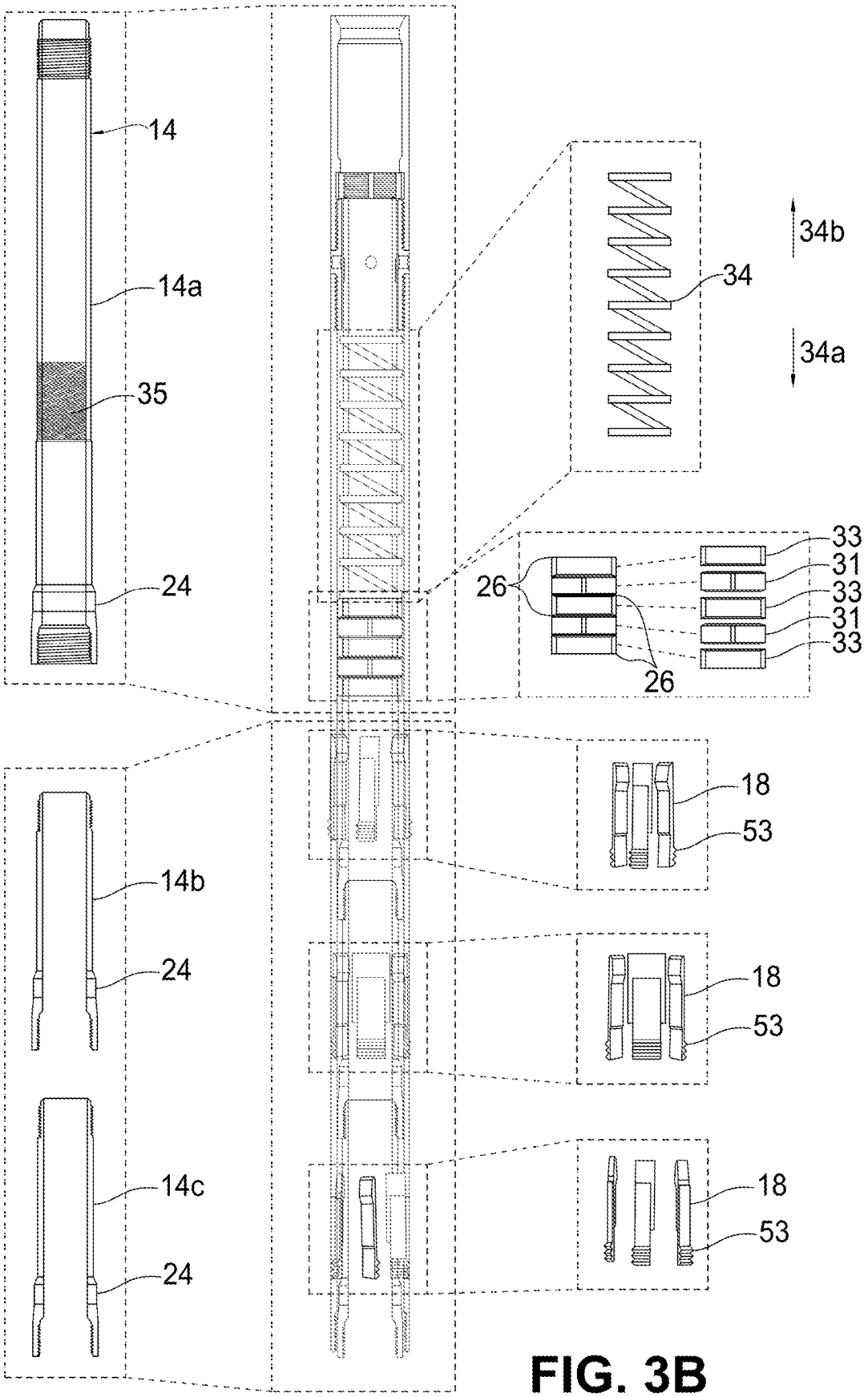

FIG. 3A shows a cross-sectional exploded view of the mandrel section 14 and associated elements. The mandrel section 14 may be a single unitary piece, or may be formed of a number of individual sections 14*a*-14*d* that are attached to each other via, for example, threaded ends of the individual sections, as shown in FIGS. 3A and 3B. FIG. 3B shows that a protruding portion 24 is located at one or more points along the mandrel section 14. In the embodiment in which the mandrel section 14 is formed of individual sections 14*a*-14*d*, the protruding portion 24 may be located at an end portion of one or more of the individual sections 14*a*-14*d*, such that the interior of the protruding portion 24 includes threads for engaging with threads of an adjacent individual section. Each protruding portion 24 is configured to engage one or more of the locking slips 18, when the mandrel section 14 is moved upward within and relative to the body section 12, to radially press the locking slips 18 outward to protrude out of the corresponding sets of openings 16. Importantly, the mandrel section 14 is provided with a central bore that allows fluid to flow through the mandrel section 14. In a case in which the end of tubing carrier tool 10 is used in a 2 inch diameter tubular 100, the inner diameter of the mandrel section 14 (i.e., the central bore) many be 1 and 1/16 inches. Of course, the inner diameter of the mandrel section 14 may be smaller or greater than 1 and 1/16 inches depending on the size of the tubular 100 in which the end of tubing carrier tool 10 is to be inserted. Each of the locking slips 18 comprises at least one radially extending protrusion 53, as shown in FIG. 3B, that extends through a respective one of the circumferentially correlated plurality of openings 16 upon engagement of the protruding portion 24 against the locking slips 18 to press the at least one radially extending protrusion 53 against an inner surface of the tubular 100. The at least one radially extending protrusion 53 of the locking slips 18 pressing against the inner surface of the tubular 100 anchors and releasably locks the end of tubing carrier tool 10 to the tubular 100 and prevents the end of tubing carrier tool 10 from sliding out of the tubular 100 and falling downhole. In a preferred embodiment, each locking slip has three radially extending protrusion 53. FIG. 3B illustrates an embodiment in which a total of nine locking slips 18 are provided in three sets of three locking slips 18. In each set, the three locking slips 18 are arranged circumferentially around the mandrel section 14, and may be arranged out of phase with each other as shown in FIGS. 1B and 3B. Each set of three locking slips 18 may at full engagement with the tubular become encompassed by at least 50 percent of the corresponding and adjacent inside diameter of the wall of the tubular 100. Thus, the offset spacing of each of the sets with a combined total of nine locking slips 18 may allow the sets to cover at least 150 percent, or a total of 540 degrees, of the corresponding and adjacent inside wall of the tubular 100. Further, the width of the nine locking slips 18 provide more slip holding area than the 360 degree of the full internal bore of the tubular 100. A proximal end of the mandrel section 14 includes a threaded portion or area for engaging with the latch-and-lock mechanism 27 of the shear ring 23.

Figure 4A:
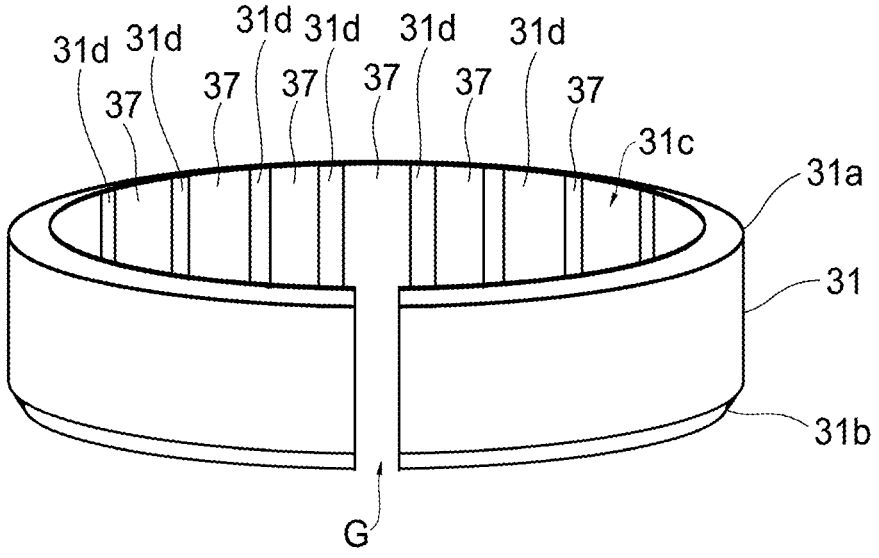
FIGS. 4A and 4B illustrate an embodiment of a c-shaped ring of a mandrel locking ring.
Figure 4B:
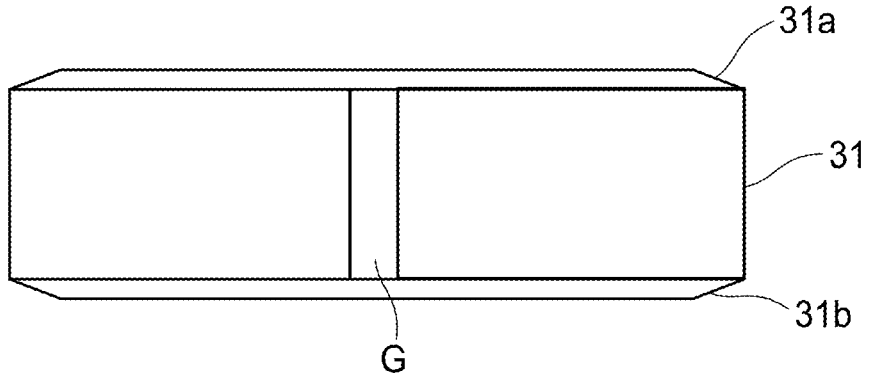
Figure 5A:
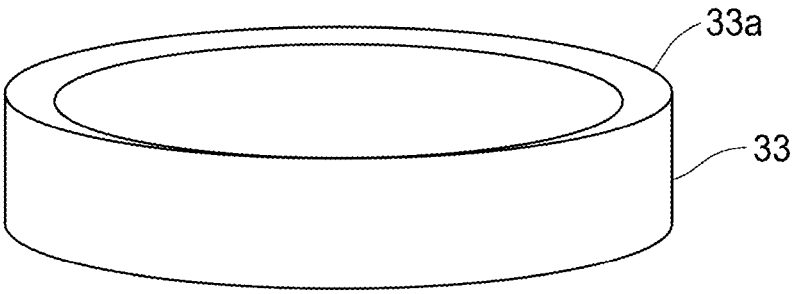
FIGS. 5A and 5B illustrate an embodiment of a pressure ring of the mandrel locking ring.
Figure 5B:
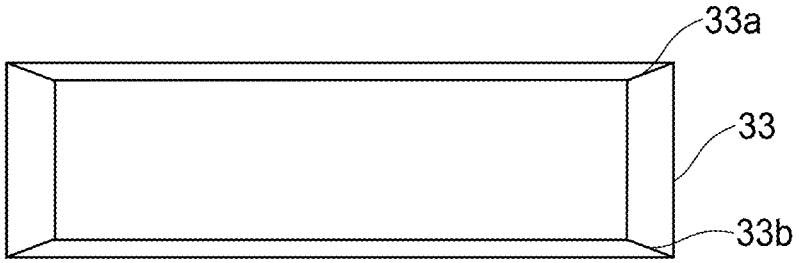
Figure 6:
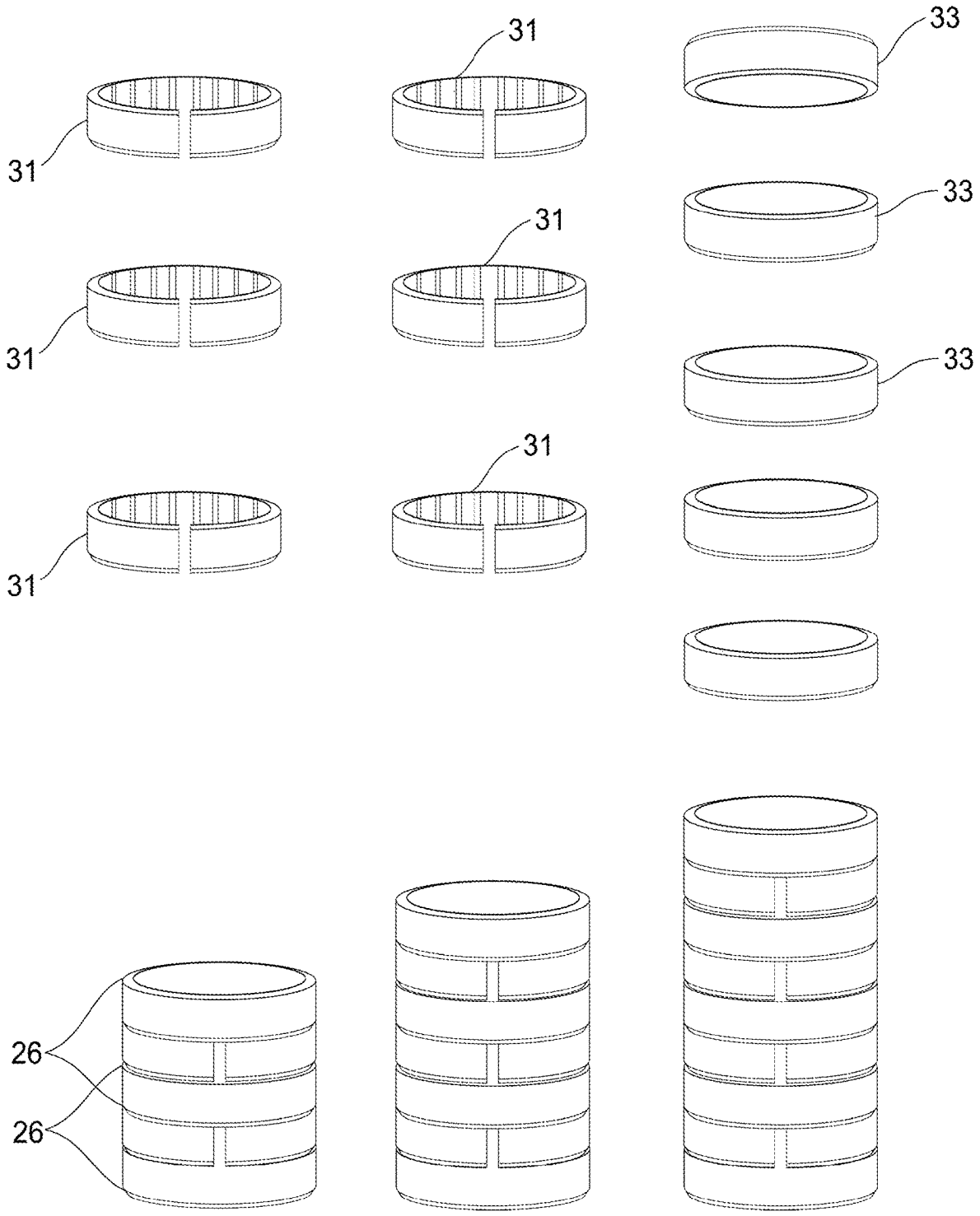
FIG. 6 illustrates an embodiment of different numbers of locking rings.

The mandrel section 14 further includes one or more mandrel locking rings 26 for gripping a portion of the mandrel section 14. Each mandrel locking ring 26 comprises a c-shaped ring 31 positioned between two pressure rings 33 as shown in FIG. 3B. The c-shaped ring 31 includes an inner diameter, and is "c-shaped" because it does not form a complete circle. There is a gap "G" in the wall of the c-shaped ring 31, as shown in FIGS. 4A and 4B. FIG. 4A shows a perspective view of the c-shaped ring 31, and FIG. 4B shows a side view of the c-shaped ring 31. The c-shaped ring 31 is positioned between two pressure rings 33, shown in FIGS. 3, SA and SB, that transmit a compression force to the c-shaped ring 31. FIG. 5A shows a perspective view of a pressure ring 33, and FIG. 5B shows a side view of the pressure ring 33. The inner diameter of the c-shaped ring 31 decreases via the compression force so that the c-shaped ring 31 grips a portion of the mandrel section 14 via the compression force. For instance, the outer circumferential corners 31*a*, 31*b* of the c-shaped ring 31 are chamfered, and match with corresponding circumferential protrusions 33*a*, 33*b* at outer circumferential portions of the pressure rings 33. A force, such as an axial force shown by the arrow 34*a* in FIG. 3B, on the pressure rings 33 presses the pressure rings 33 on opposite sides of the c-shaped ring 31 so that the circumferential protrusions 33*a*, 33*b* of the pressure rings 33 press against the circumferential corners 31*a*, 31*b* of the c-shaped ring 31. The axial force on the pressure rings 33 may be exerted via the biasing device 34, as discussed in further detail below. That pressure from the pressure rings 33 forces the gap "G" in the wall of the c-shaped ring 31 to close, which decreases the inner diameter of the c-shaped ring 31. The decrease of the inner diameter causes the inner surface 31*c* of the c-shaped ring 31 to grip a portion of the mandrel section 14. In one embodiment, the portion of the mandrel section 14 that is gripped by the c-shaped ring 31 is a knurled area 35. The inner surface 31*c* of the c-shaped ring 31 may comprise a plurality of axially extending recesses 37 which form teeth 31*d* on the inner surface 31*c*. The surface 31*e* may also be knurled or counter-knurled. The teeth 31*d* are configured to catch on the knurled area 35 of the mandrel section 14 to improve the grip of the c-shaped ring 31 on the mandrel section 14. In an alternative embodiment, the outer surface of the c-shaped ring 31 may comprise a plurality of axially extending recesses (not shown in FIG. 4A) which form teeth (not shown in FIG. 4A) on the outer surface. In this case, the outer surface of the c-shaped ring 31 may also be knurled or counter-knurled to match a corresponding knurled area (not shown) of the body section 12. In a similar manner to the configuration on the inner surface 31*c*, the teeth on the outer surface are configured to catch on the knurled area of the body section 12 so that the c-shaped ring 31 grips to the body section 12 when pressure from the pressure rings 33 forces the gap "G" in the wall of the c-shaped ring 31 to open, which increases the inner diameter of the c-shaped ring 31. In a further embodiment, both the outer surface and the inner surface 31*c* of the c-shaped ring 31 include axially extending recesses and/or knurled areas (not shown). Whether the recesses and teeth are on the inner surface 31*c* of the c-shaped ring 31 or on the other surface of the c-shaped ring 31 may depend on the size and/or material of the end of tubing carrier tool 10 and its component parts. The illustrated embodiment in FIG. 3B shows two c-shaped rings 31 and three pressure rings 33 arranged in alternating sequence, for a total of two mandrel locking rings 26 in the illustrated embodiment. However, the number of locking rings 26 may be one, or three or more as shown in FIG. 6. In an alternative embodiment, the c-shaped ring 31 may be knurled on the outer edge to engage a corresponding part of the body section 12 which may also be knurled to achieve a grip to releasably hold the mandrel section 14 to the body section 12.

An outer portion of the mandrel section 14 includes a biasing device 34. The biasing device 34 may be a coil spring. The biasing device 34 may surround an outer circumference of the mandrel section 14 and have one end engaged with the shoulder 17 of the upper sub 29 or of the body section 12, and an opposite end engaged with a pressure ring 33 of the mandrel locking ring 26. Compression of the biasing device 34 generates the axial force 34*a* that actuates the mandrel locking ring 26 by pressing the pressure rings 33 against the c-shaped ring 31 so that the inner surface 31*e* of the c-shaped ring 31 grips the mandrel section 14 as discussed above. Compression of the biasing device 34 also generates an opposite axial force 34*b* acting on a shoulder of the upper sub 29. The biasing device 34 also carries the weight of the downhole tool, such as a sand screen (not shown), attached to the distal end of the end of tubing carrier tool 10. That is, the biasing device 34 acts as a counter-balance spring to carry the weight of the downhole tool.

Figure 7:
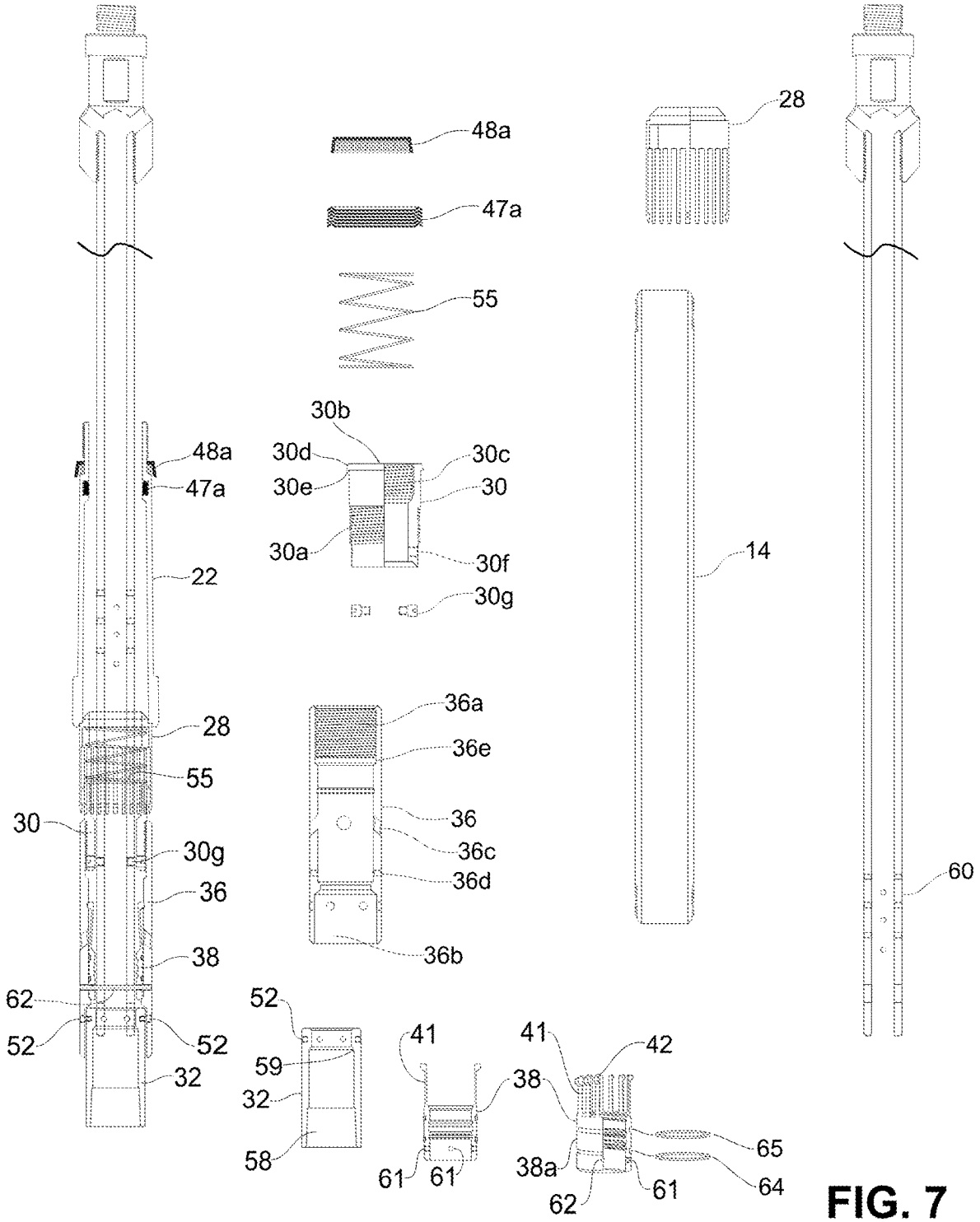
FIG. 7 illustrates a cross-sectional exploded view of the bottom part of the mandrel section according to an embodiment.
Figure 8:
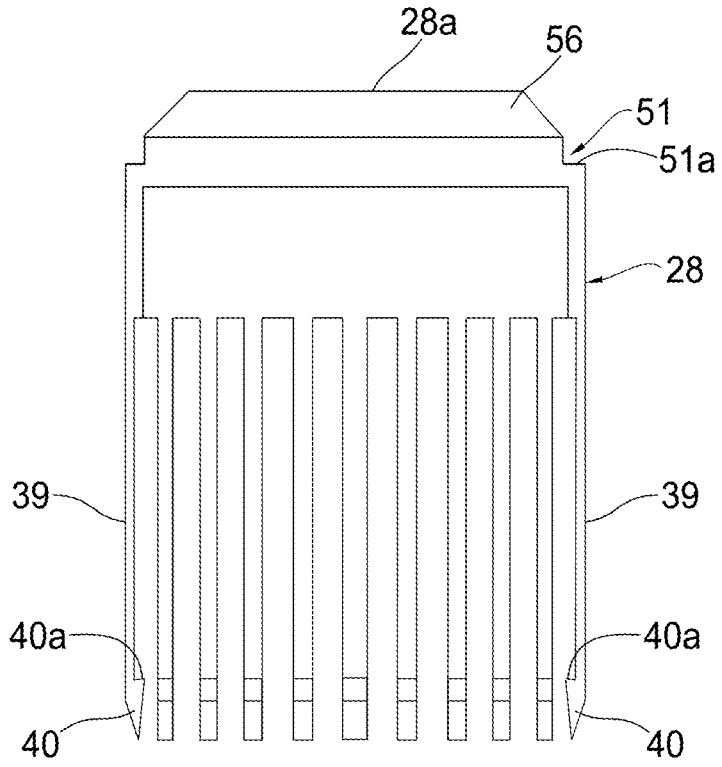
FIG. 8 illustrates an enlarged cross-sectional view of a lower collet expander according to an embodiment.
Figure 9A:
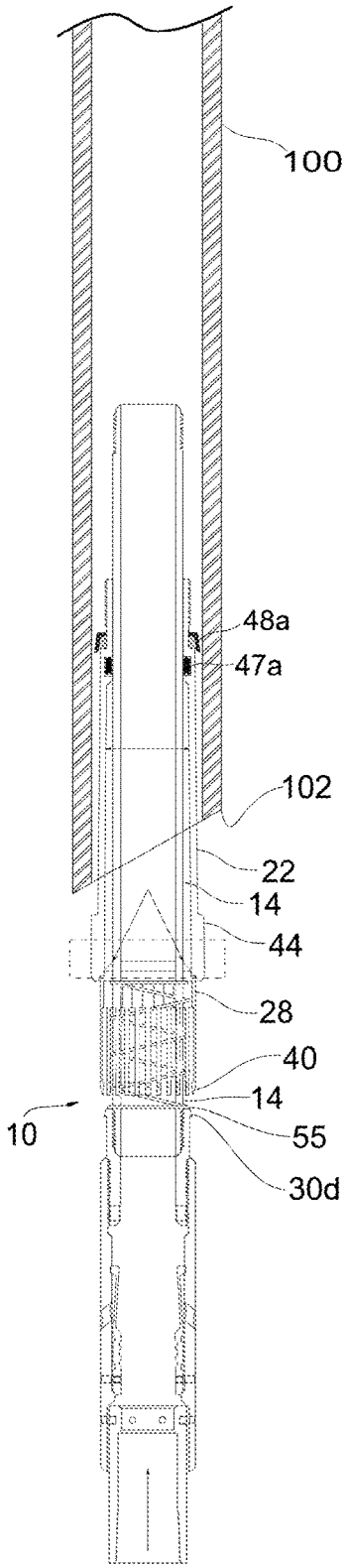
FIGS. 9A to 9C illustrate views of the lower part and upper part of the end of tubing carrier tool during the process for locking the end of tubing carrier tool to the end of a tubular.
Figure 9B:
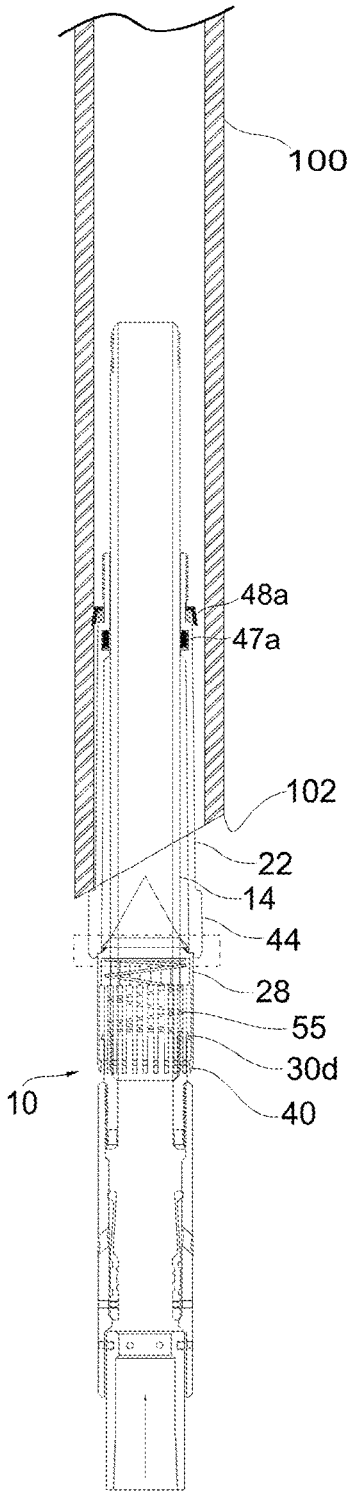
Figure 9C:
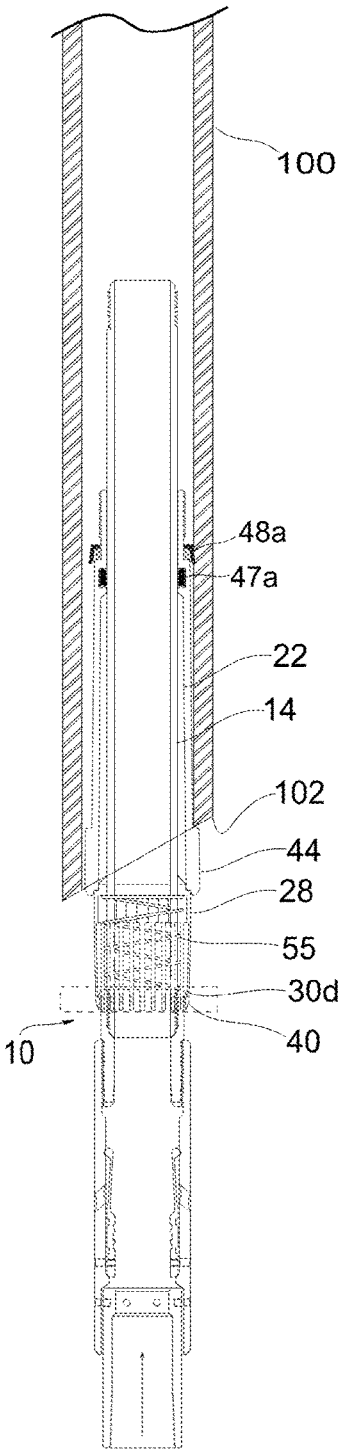

The mandrel section 14 also includes a lower collet expander 28 shown in FIGS. 7 and 8. The lower collet expander 28 comprises a main section 28*a* having a crown 56 and a plurality of axial extensions 39 as shown in FIG. 8. Each axial extension 39 includes a hook portion 40 arranged circumferentially on the outer edge of at a distal end thereof. The crown 56 of the main section 28*a* is angled or chamfered outward in a direction from the top of the crown 56 toward the hook portion 40 as shown in FIG. 8. The angled or chamfered nature of the crown 56 helps lead the lower collet expander 28 into engagement with the lower collet 22 as discussed below. The main section 28*a* of the lower collet expander 28 includes an outer indentation 51 configured to contact the inner indentation 45 of the lug 44 of the lower collet 22 when the lower collet expander 28 engages with the lower collet 22. In a preferred embodiment, the outer indentation 51 comprises a contact surface 51*a* that is perpendicular to a longitudinal axis of the end of tubing carrier tool 10 and the lower collet expander 28. The contact surface 51*a* of the outer indentation 51 contacts the contact surface 45*a* of the inner indentation 45 of the lower collet 22 when the lower collet expander 28 engages with the lower collet 22, to prevent movement of the lower collet expander 28 past the lugs 44 of the lower collet 22. The diameter of the main section 28*a* at the outer indentation 51 is slightly greater than the diameter of the inner indentation 45 of the lower collet 22 engagement of the lower collet expander 28 with the lower collet 22 (i.e., at the contact surfaces 45*a*, 51*a*) via movement of the lower collet expander 28 toward the lower collet 22 causes the lugs 44 of the lower collet 22 to move radially outward from an initial position shown in FIG. 9A to an "expanded position" shown in FIG. 9B. Without the outer indentation 51, the lower collet expander 28 may undesirably wedge with the lower collet 22 in way that could prevent the lower collet expander 28 from releasing with the lower collet 22 when the end of tubing carrier tool 10 is to be withdrawn from the tubular 100, as discussed herein. In the "expanded position", the shoulder 50 of the lugs 44 abuts against the end 102 of the tubular 100 as shown in FIGS. 9B and 9C, so that the lugs 44 are prevented from entering the interior of the tubular 100 as discussed below. The shoulder 50 of the lugs 44 abuts against the end 102 of the tubular 100 in the releasably locked state of the end of tubing carrier tool 10 with the tubular 100, as discussed below. In addition, the hook portion 40 of each axial extension 39 includes first contact surface 40*a* that is at an angle other than 90 degrees relative to a longitudinal axis of the end of tubing carrier tool 10, as shown in FIG. 8. In this state, the end of tubing carrier tool 10 is prevented from moving up-hole.

A flow sub 36 may be provided on the distal end of the mandrel section 14 as shown in FIG. 7. The flow sub 36 includes a threaded proximal end 36*a* and an opened distal end 36*b*. One or more angled fluid flow ports 360, between the proximal end 36*a* and the distal end 36*b*, are provided through the wall of the flow sub 36. The angled fluid flow ports 36*c* allow fluid to flow into the flow sub 36 during insertion of the end of tubing carrier tool 10 into a tubular 100, so that the end of tubing carrier tool 10 can more easily descend down the tubular. The flow sub 36 further includes one or more sets of shear holes 36*d* for accommodating shear screws or pins 52, or other types of breakable elements. The shear screws or pins 52 releasably attach a lower retrieving sub 32 to the distal end 36*b* of the flow sub 36, as discussed below. The flow sub 36 additionally includes an internal shoulder 36*e* for accommodating a hook part 42 of a flow collet 38, discussed below.

The flow sub 36 is attached to the distal end of the mandrel section 14 via a cross over sub 30 that intervenes between the distal end of the mandrel section 14 and the flow sub 36, as shown in FIG. 7. The cross over sub 30 may include a threaded distal end 30*a* that attaches to the threaded proximal end 36*a* of the flow sub 36. The proximal end 30*b* of the cross over sub 30 may include an attachment for attaching to the distal end of the mandrel section 14. The attachment may include threads 30*c*. In alternative embodiments, the cross over sub 30 may be attached to the distal end of the mandrel section 14 via other attachment means. A biasing device 55, such as a coil spring, may be provided between the lower collet expander 28 and the cross over sub 30. The biasing device 55 provides a force that biases the lower collet expander 28 in an axial direction away from the cross over sub 30. The proximal end 30*b* of the cross over sub 30 comprises a protruding lip 30*d* having a second contact surface 30*e* for engaging with the first contact surface 40*a* of the hook portion 40 of the lower collet expander 28 when the force of the biasing device 55 is overcome by movement of the cross over sub 30 toward the lower collet expander 28, as discussed below. The second contact surface 30*e* is at an angle other than 90 degrees relative to a longitudinal axis of the end of tubing carrier tool 10 to match the angle of the first contact surface 40*a*. Having the angle of the first contact surface 40*a* and the second contact surface 30*e* be other than 90 degrees relative to a longitudinal axis of the end of tubing carrier tool 10 provides for a stronger axial engagement between the lower collet expander 28 and the cross over sub 30 when the lower collet expander 28 and the cross over sub 30 are engaged with each other. The cross over sub 30 may further include shear recesses 30*f* for accommodating shear screws or pins 30*g*, or other types of breakable elements.

Figure 10A:
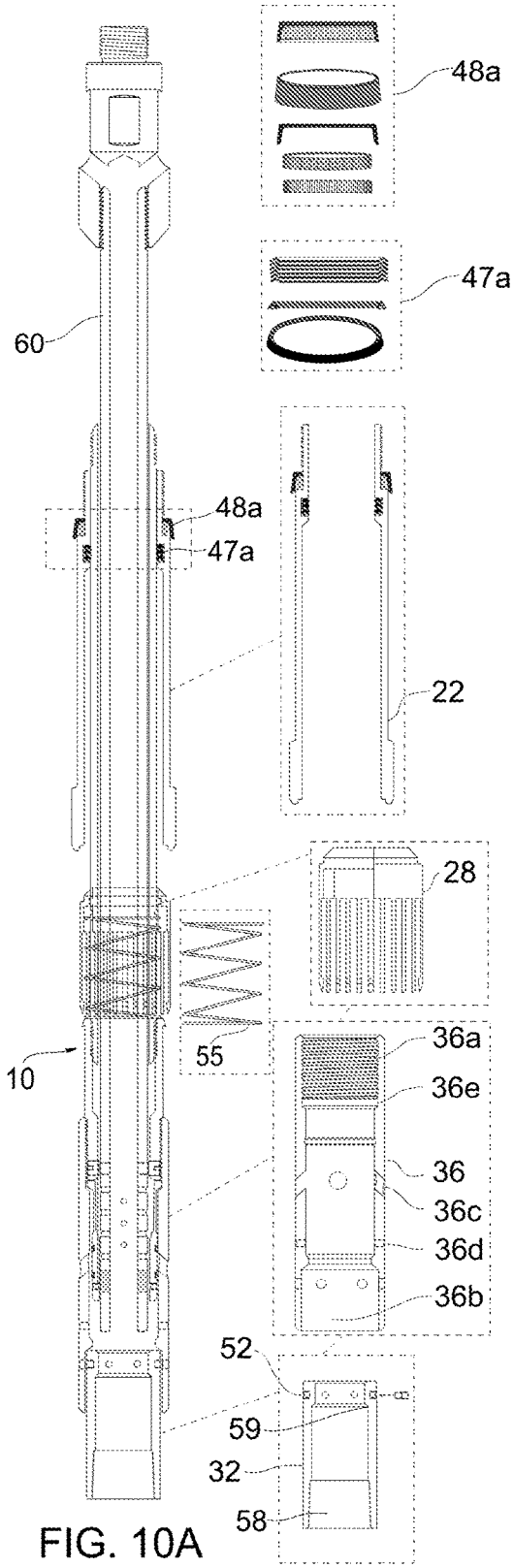
FIGS. 10A and 10B illustrate views of the components of the end of tubing carrier tool and interaction of the end of tubing carrier tool with a running tool for inserting the end of tubing carrier tool into a wellbore.
Figure 10B:
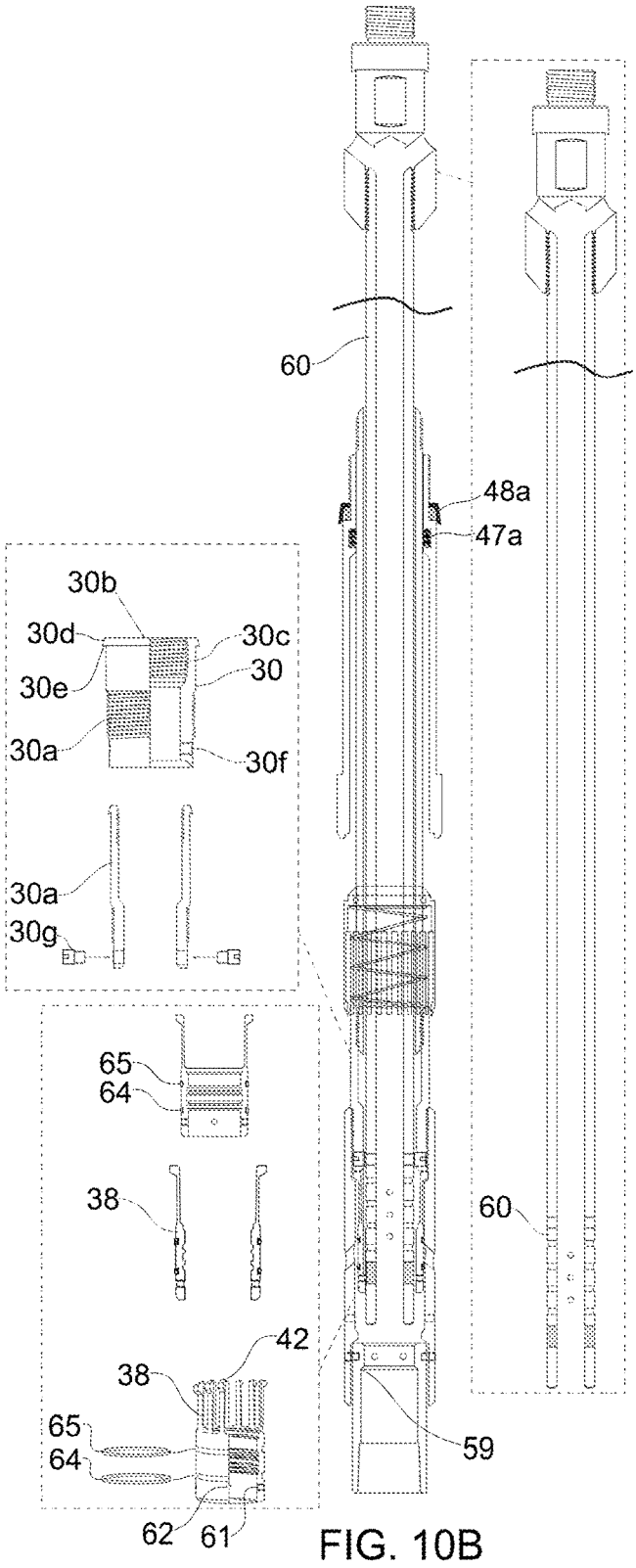

A flow collet 38 is provided within the flow sub 36, and is disposed to be slidable inside the flow sub 36. The flow collet 38 includes three or more extending portions 41 that extend from a main body 38*a* of the flow collet 38. Each of the extending portions 41 includes a radially outward facing hook part 42 for engaging and latching to the internal shoulder 36*e* of the flow sub 36. The contact surfaces of the hook part 42 and the internal shoulder 36*e* may be at an angle other than 90 degrees relative to a longitudinal axis of the end of tubing carrier tool 10, Having the angle of the contact surfaces be other than 90 degrees relative to a longitudinal axis of the end of tubing carrier tool 10 provides for a stronger axial engagement between the flow collet 38 and the flow sub 36 when the hook part. 42 engages the internal shoulder 36*e*. The flow collet 38 may further include shear recesses 61 for accommodating a shear pin 62, or other types of breakable element. The shear pin 62 may be used to releasably attach the flow collet 38 to a distal end of a running tool 60 (see FIGS. 7, 10B and 17A), as discussed in further detail below. The flow collet 38 additionally includes a sealing portion that includes at least an upper seal 65 and a lower seal 64 spaced axial from each other. The upper seal 65 and the lower seal 64 abut the internal surface of the flow sub 36, and are intended to seal the fluid flow ports 36*c* closed when the flow collet 38 slides within the flow sub 36 toward the cross over sub 30 and the hook part 42 engages the internal shoulder 36*e* of the flow sub 36. In such a position, the upper seal 65 is located on one side (e.g., above) of the fluid flow ports 36*c* and the lower seal 64 is located on the other side (e.g., below) of the fluid flow ports 36*c*, as shown in FIGS. 7, 10A and 10B. The sealing portion 64 may be formed of an elastomeric material. The upper seal 65 and the lower seal 64 may also be formed of an elastomeric material.

As discussed above, a lower retrieving sub 32 is attached to the distal end 36*b* of the flow sub 36, and is provided at least partially in the flow sub 36 below the flow collet 38. The lower retrieving sub 32 is attached to the distal end 36*b* of the flow sub 36 via shear screws or pins 52. The shear screws or pins 52 are some examples of the element for attaching the lower retrieving sub 32 to the flow sub 36. Alternative attachment devices, other than shear screws or pins 52, may be used so long as they are designed to be breakable (e.g., sheared) with a predetermined force to release the lower retrieving sub 32 from the attachment to the flow sub 36. In an alternate embodiment, two sets of shear screws or pins 52 may be used, including an upper set and a lower set (not shown). In an embodiment, the upper set of shear screws or pins 52 may be formed of brass, and the lower set of shear screws or pins 52 may be formed of steel. The lower portion of the lower retrieving sub 32 may include a connector, such as threads 58, for connecting to a down-hole tool, such as a sand screen (not shown). The lower retrieving sub 32 may further include a retrieving sub portion 59, as shown in FIGS. 7, 10A and 10B.

FIGS. 10A and 10B also illustrate one example of a running tool 60 that may be used to run the end of tubing carrier tool 10 into the tubular 100 and to the bottom end 102 of the tubular 100, as discussed in further detail below.

Figure 11A:
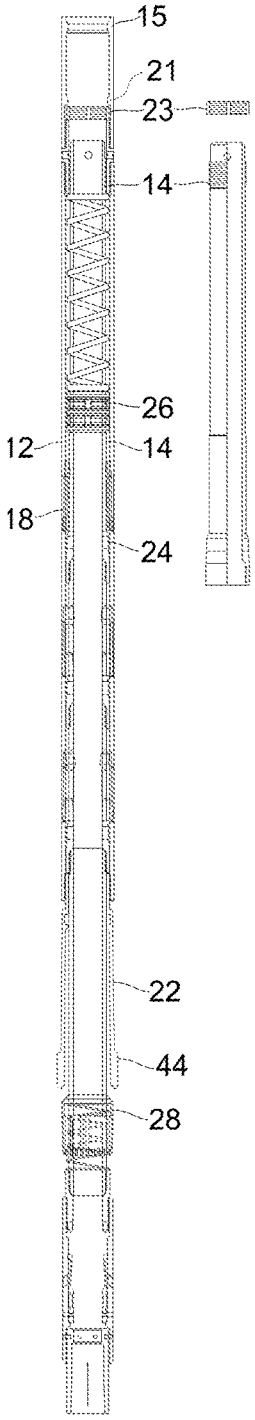
FIG. 11A illustrates a cross-sectional view of the mandrel section within the body section, according to an embodiment.
Figure 11B:
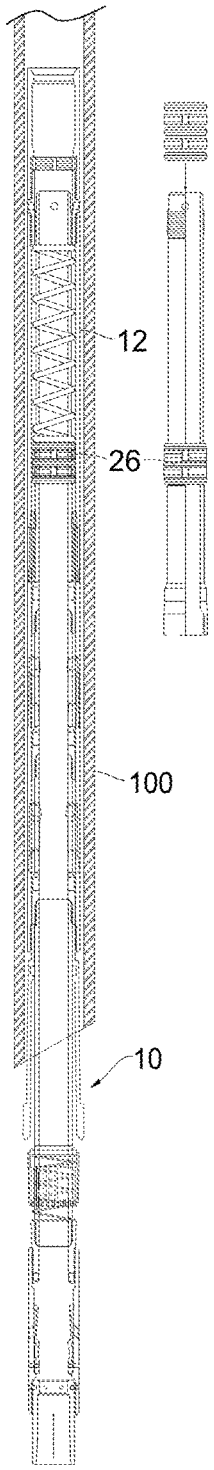
FIG. 11B illustrates a cross-sectional view of the end of tubing carrier tool within the tubular according to an embodiment.

FIG. 11A illustrates a cross-sectional view of the mandrel section 14 within the body section 12, according to an embodiment. Generally, the mandrel section 14 is movable (e.g., slidable) within and relative to the body section 12 when: the shear ring 23, which is attached to the recovery sub 15 of the body section 12, is unattached to the mandrel section 14; the mandrel locking ring 26 is not engaged with the mandrel section 14; the protruding portion 24 of the mandrel section 14 is unengaged with the locking slips 18; and the lower collet expander 28 is unengaged with the lower collet 22, as shown in FIGS. 9A, 10A and 11A. FIG.

11B illustrates a cross-sectional view of the body section 12 of FIG. 11A inside a tubular 100, according to an embodiment.

Figure 12A:
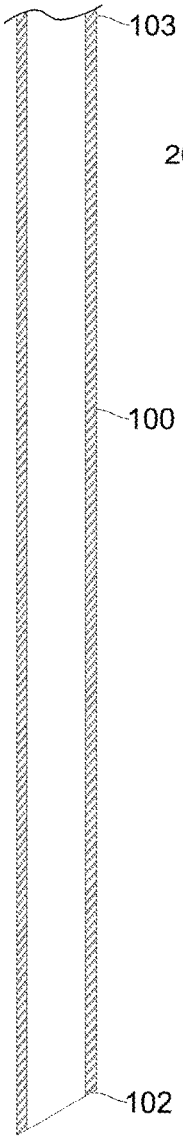
FIG. 12A illustrates a cross-sectional view of a tubular according to an embodiment.
Figure 12B:
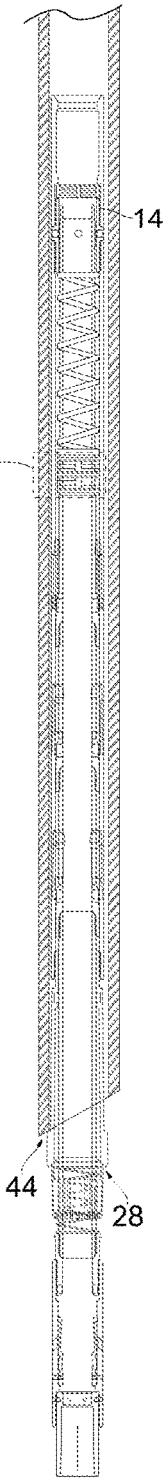
FIG. 12B illustrates a cross-sectional view of an end of tubing carrier tool within the tubular according to an embodiment.

FIG. 12A illustrates a cross-sectional view of an exemplary tubular 100. The size and shape of the tubular 100 is not particularly limiting, and must simply be large enough to allow the end of tubing carrier tool 10 to be inserted there-through. The present disclosure encompasses nominal and non-nominal tubular sizes having an inner diameter of various sizes. The outer diameter of such tubulars may be, for example, (but not limited to) 2 inches, 2.5 inches, 3 inches, 4 inches, 5 inches, or 6 inches. FIG. 12 shows that the exemplary tubular 100 includes a "mule shoe" bottom end 102. The shape of the "mule shoe" bottom end 102 may help guide the tubular into the casing during running of the tubular into the well. However, the bottom end 102 of the tubular 100 may be without the "mule shoe" shape, and may simply be a "flat bottom" shape, like the top end 103 of the tubular 100 shown in FIG. 12. FIG. 12B illustrates a cross-sectional view of the end of tubing carrier tool 10 inside the tubular 100 and attached to the "mule shoe" bottom end 102, according to an embodiment.

Figure 13:
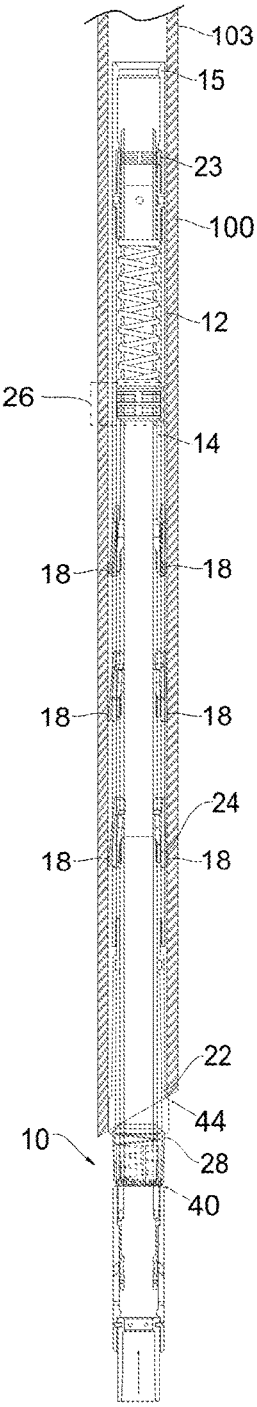
FIG. 13 illustrates another cross-sectional view of an end of tubing carrier tool within the tubular according to an embodiment.

FIG. 13 illustrates a cross-sectional view of the end of tubing carrier tool 10 within the tubular 100 according to an embodiment. FIG. 13 shows the state in which the end of tubing carrier tool 10 is being inserted through the end of the tubular 100. In this state, the end of tubing carrier tool 10 is not locked to the end 102 of the tubular 100. Nor is the mandrel section 14 locked to the body section 12. That is, the mandrel section 14 is still movable (e.g., slidable) within and relative to the body section 12. The mandrel section 14 is still movable (e.g., slidable) within and relative to the body section 12 because the shear ring 23, which is attached to the recovery sub 15 of the body section 12, is unattached to the mandrel section 14; the mandrel locking ring 26 is not engaged with the mandrel section 14; the protruding portion 24 of the mandrel section 14 is unengaged with the locking slips 18; and the lower collet expander 28 is unengaged with the lower collet 22.

Figure 17A:
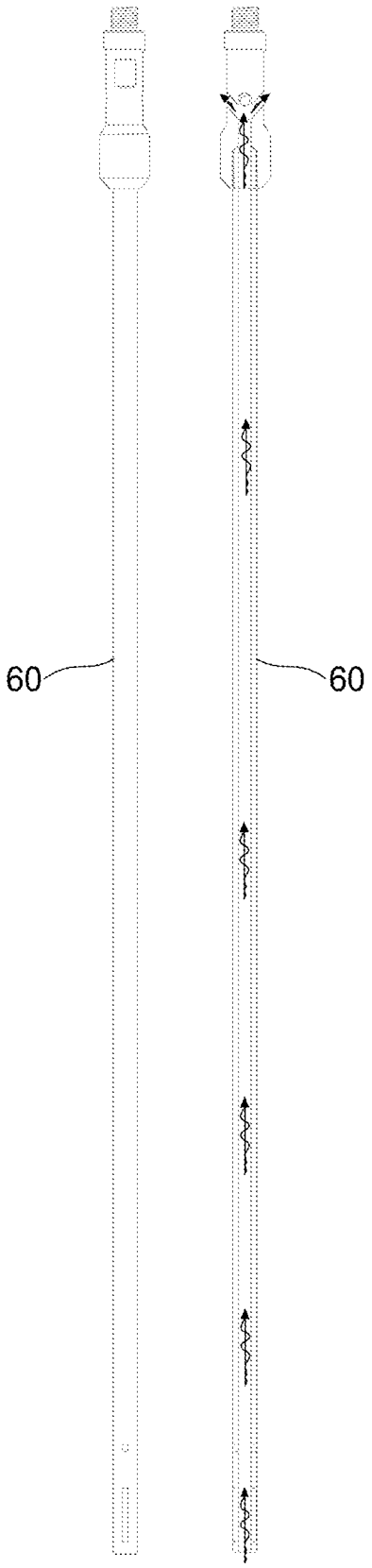
FIGS. 17A and 17B illustrate a running tool for inserting the end of tubing carrier tool into a tubular according to an embodiment.
Figure 17B:
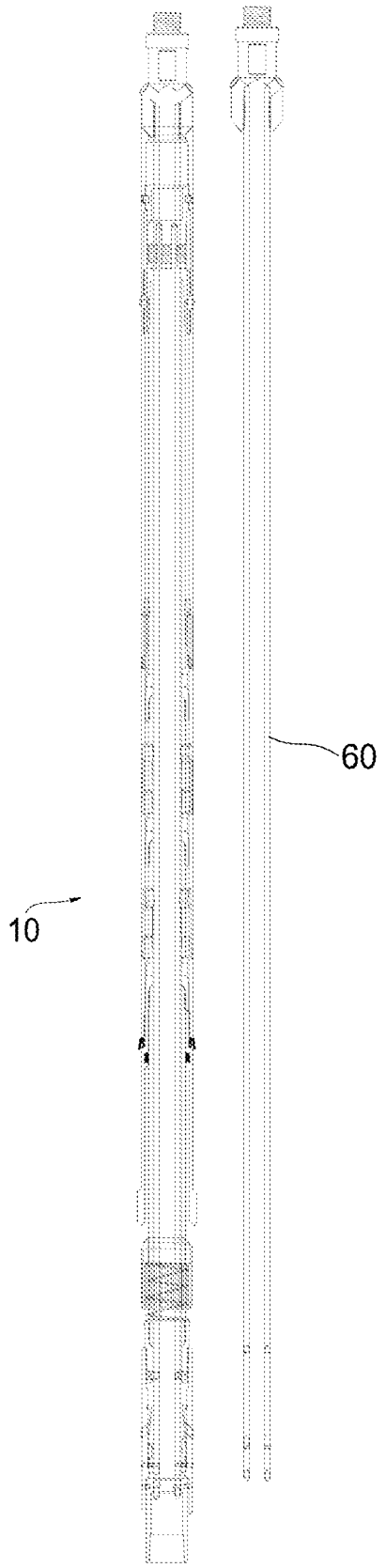

The end of tubing carrier tool 10, as disclosed above, is configured to operate in the following manner. The end of tubing carrier tool 10 includes the mandrel section 14 along with its components discussed above, provided within the body section 12 including its components discussed above. The end of tubing carrier tool 10 is releasably attached to the end of a running tool 60 via the shear pin 62 of the flow collet 38 and the shear screws or pins 30*g* of the cross over sub 30, as shown in FIGS. 7, 17A and 17B. That is, the shear pin 62 of the flow collet 38 and the shear screws or pins 30*g* of the cross over sub 30 attach to the end of a running tool 60 to releasably hold the end of tubing carrier tool 10 on the running tool 60. The running tool 60 with the end of tubing carrier tool 10 on an end thereof is inserted into the tubular 100 through a first end 103 of the tubular 100, and is moved through the tubular 100 until at least the lugs 44 of the lower collet 22 protrude out of the opposite second end 102 of the tubular 100 (see, e.g., FIGS. 9A, 9B, 11B and 12B). The running tool 60 comprises a hollow internal bore and an open distal end as shown in, for example, FIG. 10B. The proximal end of the running tool 60 comprises an opening above a collar 63 for allowing fluid flow through the running tool 60 during the running of the end of tubing carrier tool 10 in the tubular 100 and encountering a fluid level. In an embodiment, the angled prongs 22*a* are slightly bent radially inward to fit within the internal diameter of the tubular 100. Once out of the opposite end 102 of the tubular 100, the angled prongs 22*a* expand to their initial form such that the outer diameter of the lower collet 22 at the lugs 44 is greater than the inner diameter of the tubular 100. The running tool 60 is then pulled in a direction opposite to the insertion direction, i.e., in a direction toward the first end of the tubular 100 in order to releasably lock the mandrel section 14 to the body section 12. The opposite directional pull (most often an upward pull) of the running tool 60 axially moves the mandrel section 14 relative to the body section 12 so that the proximal end of the mandrel section 14 attaches to the shear ring 23, as shown in FIG. 13. During this movement of the mandrel section 14, the biasing device 34 is compressed between the shoulder 17 of the upper sub 29 and the mandrel locking ring 26. The compression of the biasing device 34 results in an axial force on the pressure rings 33 of the mandrel locking ring 26, and thus transmits an axial force to the c-shaped ring(s) 31. The axial force from the pressure rings 33 causes the diameter of the c-shaped ring(s) 31 to decrease so that the inner surface 31*c* of the c-shaped ring(s) 31 grips a portion of the mandrel section 14. The upward axial movement of the mandrel section 14 also causes the flow sub 36 and its components to press against the force of the biasing device 55 located between the cross over sub 30 and the lower collet expander 28, so that the protruding lip 30*d* of the cross over sub 30 engages with the hook portion 40 of the lower collet expander 28. That is, the second contact surface 30*e* of the protruding lip 30*d* engages with the first contact surface 40*a* of the hook portion 40 at the extensions 39 of the lower collet expander 28 (see FIG. 9C). The movement of the mandrel section 14 further causes the lower collet expander 28 to be engaged with the lower collet 22 at the contact surface 45*a* of the inner indentation 45 of the lugs 44 of the lower collet 22 and the contact surface 51*a* of the outer indentation 51 of the lower collet expander 28. The engagement of the lower collet expander 28 with the lower collet 22 causes the lugs 44 of the lower collet 22 to move radially outward to the "expanded position" thus preventing the end of tubing carrier tool from moving up-hole discussed above.

The end of tubing carrier tool 10 is releasably locked at the end 102 of the tubular 100 when the mandrel section 14 is releasably locked to the body section 12, as discussed above, and further movement of the mandrel section 14 in the same upward axial direction causes the protruding portion(s) 24 of the mandrel section 14 to be engaged with the locking slips 18. Engagement of the protruding portion(s) 24 with the locking slips 18 presses the locking slips 18 radially outward so that the locking slips 18 protrude out of the openings 16 in the body section 12. The protruding locking slips 1 press the radially extending protrusion 53 against an inner surface of the tubular 100 to grip the inner surface of the tubular 100. The radially extending protrusion 53 pressing against the inner surface of the tubular 100 secures the end of tubing carrier tool 10 to the tubular 100 and prevents the end of tubing carrier tool 10 from sliding out of the tubular 100 and falling downhole. The movement of the mandrel section 14 in the same upward axial direction further causes the lugs 44 of the lower collet 22, which have been moved to the "expanded position", to press against an edge of the end 102 of the tubular 100. Specifically, the shoulder 50 of the lugs 44 in the "expanded position" abuts against the end 102 of the tubular 100 (see FIGS. 9B, 9C, 11B and 12B). In the embodiment having the "mule shoe" bottom end 102 of tubular 100, the lower collet 22 may rotate about the axis of the end of tubing carrier tool 10 as the shoulder 50 of the lugs 44 slides along the "mule shoe" bottom end 102 until the grip of radially extending protrusion 53 against the inner surface of the tubular 100 prevents further movement of the body section 12 in the same axial direction. In this position, the end of tubing carrier tool 10 is releasably locked to the end 102 of the tubular 100 (see FIGS. 9C and 12B). Friction of the shoulder 50 of the lugs 44 against the end 102 of the tubular 100 also contributes to the releasable lock of the end of tubing carrier tool 10 to the end 102 of the tubular 100. The running tool 60 is detached from the releasably locked end of tubing carrier tool 10 and withdrawn from the tubular 100 when the pulling force of the running tool 60 breaks the shear pin 62 of the flow collet 38 and the shear screws or pins 30*g* of the cross over sub 30 that were holding the end of tubing carrier tool 10 on the running tool 60. The flow collet 38 is slidably moved within the flow sub 36 by the upward axial movement or upward jarring of the running tool 60, so that the hook part 42 of the flow collet 38 latches to the internal shoulder 36*e* of the flow sub 36. This movement of the flow collet 38 causes the sealing portion 64 of the flow collet 38 to seal off the fluid flow ports 36*c* of the flow sub 36 to block fluid flow through the fluid flow ports 36*c*.

Figure 14:
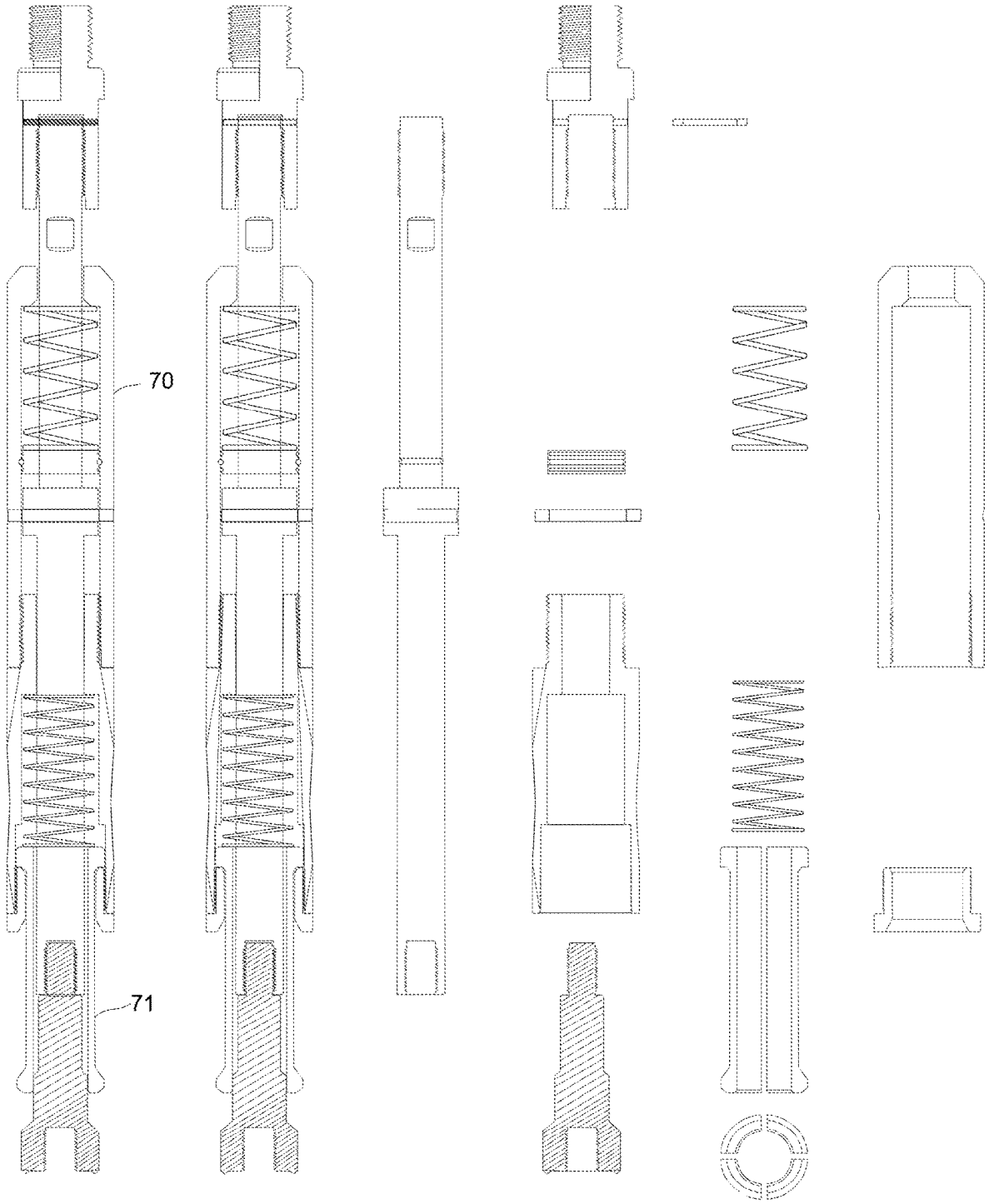
FIG. 14 illustrates a retrieving tool according to an embodiment.
Figure 15A:
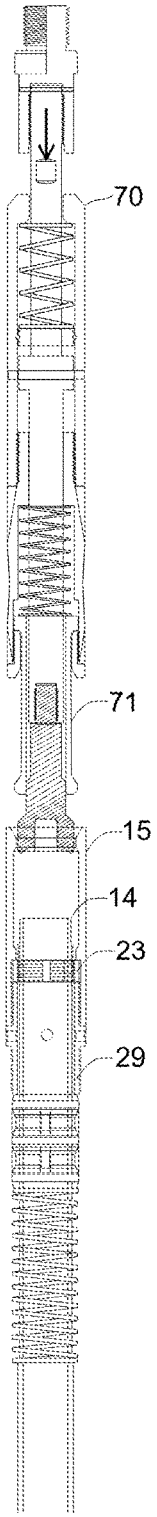
FIGS. 15A to 15F illustrate a process for retrieving the end of tubing carrier tool from within the tubular according to an embodiment.
Figure 15B:
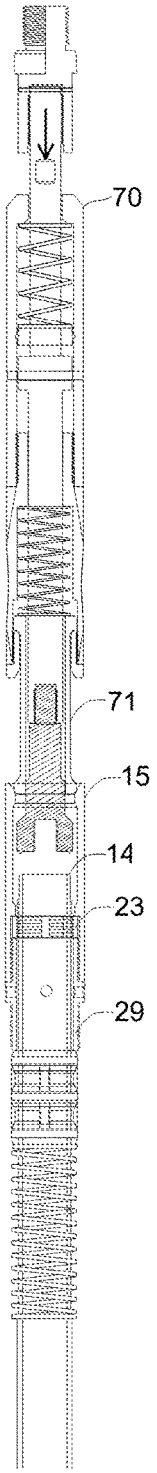
Figure 15C:
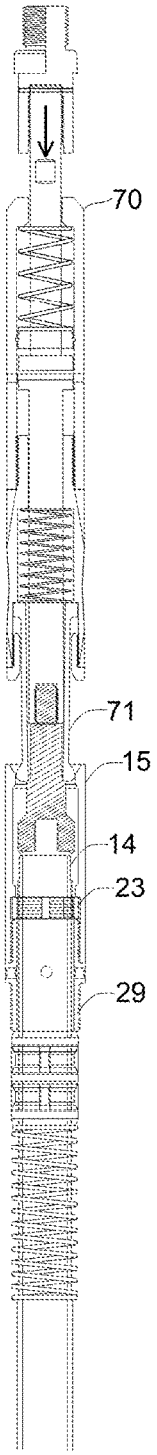
Figure 15D:
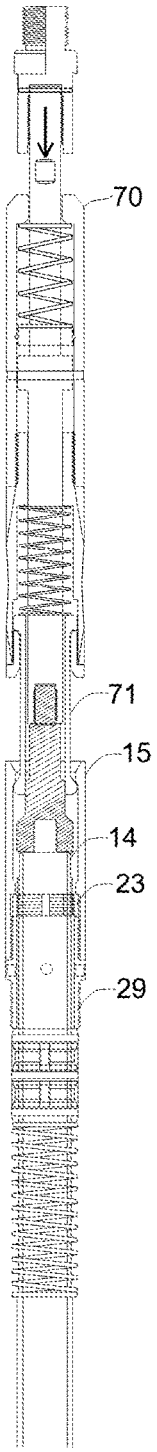
Figure 15E:
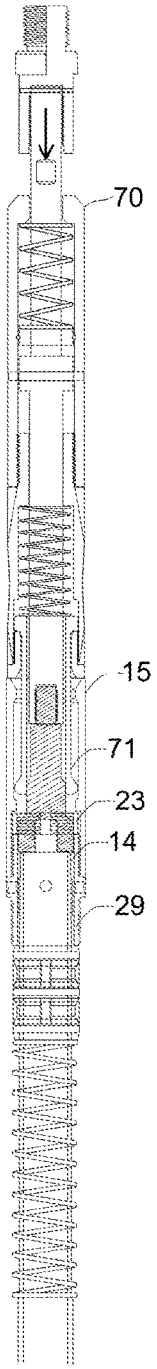
Figure 15F:
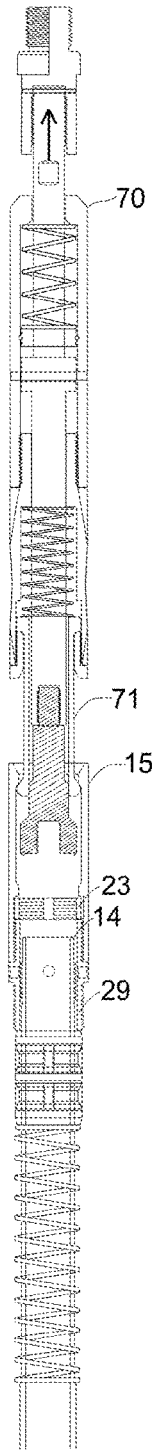
Figure 16A:
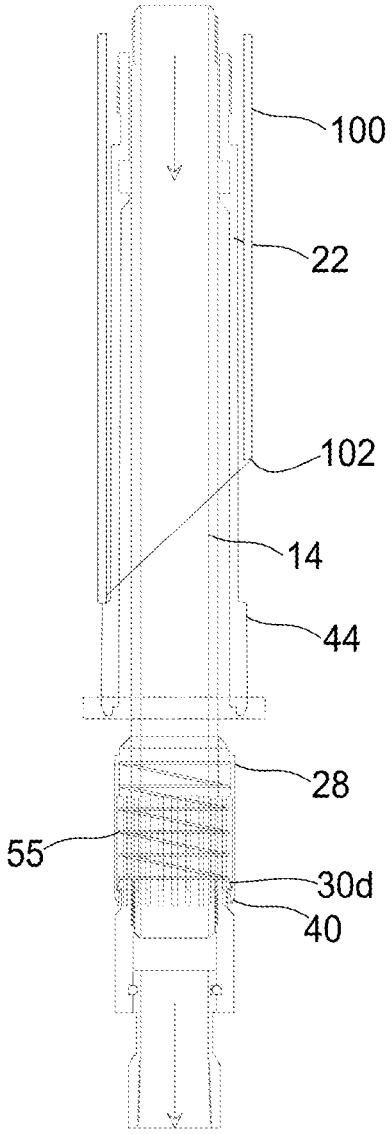
FIGS. 16A and 16B illustrate a detailed view of the lower part of the end of tubing carrier tool during the process for releasing the end of tubing carrier tool from the end of a tubular.
Figure 16B:
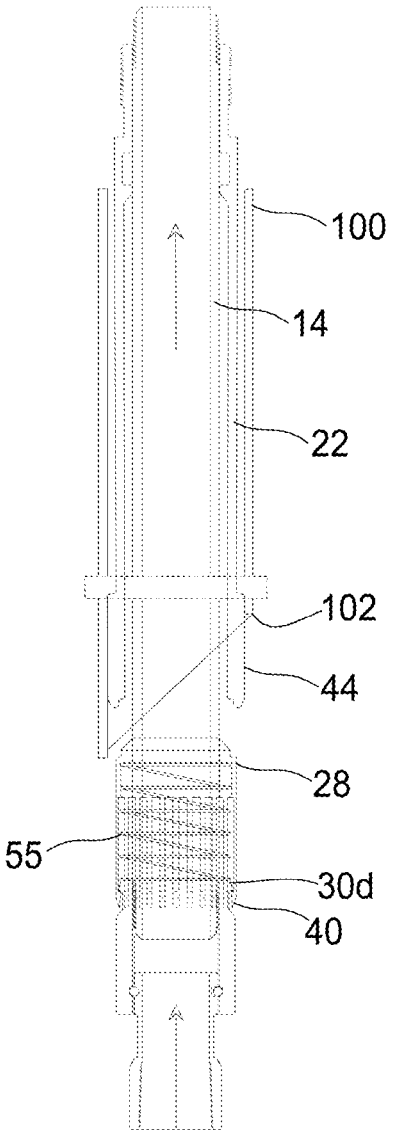

The end of tubing carrier tool 10 is released from being locked at the end 102 of the tubular 100 according to the following process. A retrieving tool 70, such as the one Illustrated in FIG. 14, is lowered onto the end of tubing carrier tool 10 and releasably attached to the proximal end of the recovery sub 15 of the body section 12, via locking dogs 71 as shown in FIGS. 15A to 15D. A downward jarring force is applied to the retrieving tool 70, or to the string having the retrieving tool 70, until the jarring force breaks the attachment between the shear ring 23 and the mandrel section 14 as shown in FIG. 15E. FIG. 15F shows separation of the mandrel section 14 from the shear ring 23. Breaking the attachment between the mandrel section 14 and the shear ring 23 causes the mandrel section 14 to move downward relative to the body section 12 by virtue of the weight of the mandrel section 14 and any downhole tool (such as a sand screen) attached to the mandrel section 14. Downward movement of the mandrel section 14 relative to the body section 12 releases the compression of the biasing device 34, which releases the force on the compression rings 33 so that the axial force from the compression rings 33 on the c-shaped ring(s) 31 of the mandrel locking ring 26 is removed. The previously decreased inner diameter of the c-shaped ring thus increases back to its initial size before the c-shaped ring(s) 31 was compressed by the compression rings 33, so that the grip of the mandrel locking ring 26 on the mandrel section 14 is released. The downward movement of the mandrel section 14 relative to the body section 12 also releases the engagement of the protruding portion(s) 24 of the mandrel section 14 with the locking slips 18, so that locking slips 18 retract back into the openings 16 of the body section. Retraction of the locking slips 18 releases the grip, and thus un-anchors the radially extending protrusion 53 of the locking slips 18 against an inner surface of the tubular 100. Further, the downward movement of the mandrel section 14 relative to the body section 12 releases the engagement of the lower collet expander 28 with the lower collet 22, as shown in FIG. 16A, such that the an angled crown 56 of the collet expander 28 releases the inner indentation 45 of the lugs 44 of the lower collet 22 and to separate, which further allows the lugs 44 of the lower collet 22 retract from the "expanded position" discussed above. The retracted lugs 44 are thus free to fit back inside the tubular 100 for withdrawal of the end of tubing carrier tool 10 from the tubular 100, as shown in FIG. 16B. The end of tubing carrier tool 10 can thus be withdrawn from the tubular 100 in a direction towards the surface of the wellbore. In some embodiments, each of the lugs 44 may be shearable from its respective prong 22*a* to allow the end of tubing carrier tool 10 to be withdrawn from the tubular 100. In such an embodiment, the shearable lugs 44 may each include one or more screws (not shown) to promote shearing of the lugs 44 when subjected to a shearing force.

In an embodiment, the downhole tool, such as a sand screen, may not be retrievable through the tubular 100. In such a case, a further downward jarring force is applied to the retrieving tool 70, or to the string having the retrieving tool 70, until the downward jarring force breaks the sets of shear screws or pins 52, or other types of breakable elements, to release the breakable attachment between the lower retrieving sub 32 and the flow sub 36, The downhole tool attached to the lower retrieving sub 32 may remain in the wellbore while the end of tubing carrier tool 10 without the lower retrieving sub 32 is withdrawn from the tubular 100 in a direction towards the surface of the wellbore.

Figures 18A, 18B, 18C, 18D, 18E, 19A, 19B:
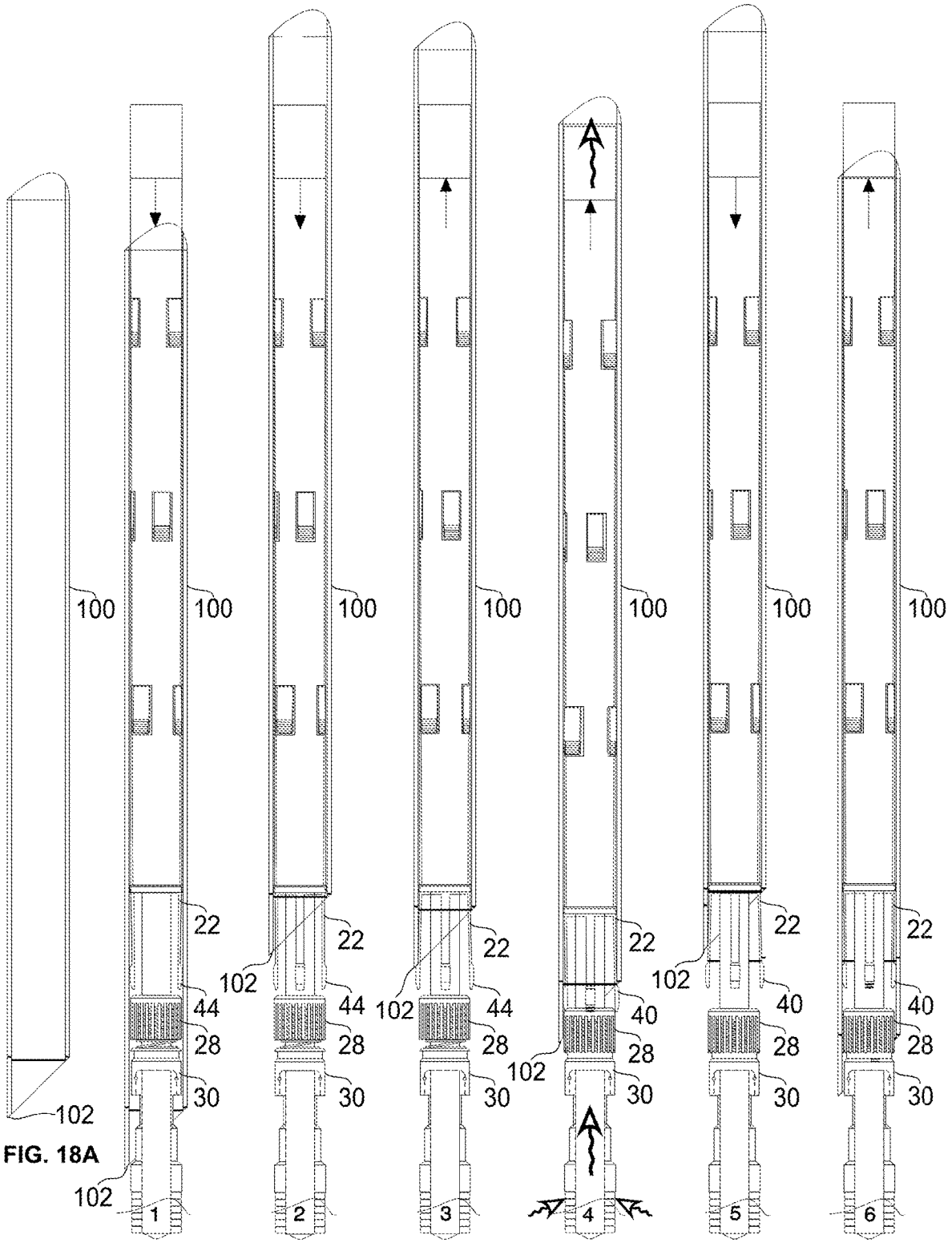
FIGS. 18A to 18E illustrate a process for locking the end of tubing carrier tool to the end of a tubular.
FIGS. 19A and 19B illustrate a process for releasing the end of tubing carrier tool from the end of a tubular.

The process for locking the end of tubing carrier tool 10 to the end 102 of a tubular 100 is illustrated in FIGS. 18A to 18E. Initially, a dummy run of a running tool 60 down the tubular 100 without the end of tubing carrier tool 10 thereon may be performed (i.e., before the end of tubing carrier tool 10 is attached to the running tool 60) to ensure that there is no obstruction inside the tubular 100 that would prevent the end of tubing carrier tool 10 from exiting the tubular 100. Turning to the process shown in FIGS. 18A to 18E, a tubular 100 is provided in a wellbore as shown in FIG. 18A. The tubular 100 may be part of a casing string extending from the surface of a well. The tubular 100 includes a proximal top end 103 and distal bottom end 102, which in the illustrated embodiment is a "mule shoe" bottom end 102 as shown in FIG. 18A, However, the bottom end 102 is not limited to a "mule shoe" shape, and may be a "flat bottom" shape, like the top end 103 of the tubular 100 shown in FIG. 12A. Next, the end of tubing carrier tool 10, including the mandrel section 14 within the body section 12, and the associated components discussed above, is releasably attached to the end of the running tool 60 via the shear pin 62 of the flow collet 38 and the shear screws or pins 30*g* of the cross over sub 30 as discussed above. The running tool 60 with the end of tubing carrier tool 10 on an end thereof is then inserted into the tubular 100 through the proximal top end 103 of the tubular 100 in a first direction, e.g., downward, as shown in FIG. 18B. At this stage, the shear ring 23 in the recovery sub 15 of the body section 12 is unattached to the mandrel section 14, the mandrel locking ring(s) 26 is unengaged with the outer surface of the mandrel section 14, the protruding portion(s) 24 of the mandrel section 14 is unengaged with the locking slips 18, and the lower collet expander 28 is unengaged with the lower collet 22. The end of tubing carrier tool 10 is moved in the first direction through the tubular 100 until at least the lugs 44 of the lower collet 22 and the lower collet expander 28 protrude out of the bottom end 102 of the tubular 100 and beyond the bottom end 102, as shown in FIG. 18C. After at least the lugs 44 protrude beyond the bottom end 102 of the tubular 100, the end of tubing carrier tool 10 is ready to be releasably locked to the tubular 100, which is shown in FIGS. 18D and 18E.

To do so, the running tool 60 is then pulled in a second direction (e.g., upwards) that is opposite to the first direction. The pull of the running tool 60 first causes at least one of the lugs 44 of the lower collet 22 to come into contact with the outer edge of the end 102 of the tubular 100, as shown in FIG. 18D. Contact of the at least one lug 44 with the outer edge of the end 102 of the tubular 100 stops movement, at least initially, of the body section 12 relative to the tubular 100 due to the forces of the biasing devices 34 and 55, Continued pulling of the running tool 60 in the second direction to overcome those forces causes the proximal end of the mandrel section 14 to engage with (attach to) the latch-and-lock mechanism 27 of the shear ring 23 on the body section 12. During this movement of the mandrel section 14, the biasing device 34 is compressed between the shoulder 17 of the upper sub 29 and the mandrel locking ring 26. The compression of the biasing device 34 results in an axial force on the pressure rings 33 of the mandrel locking ring 26, which transmits the axial force to the c-shaped ring(s) 31. The axial force from the pressure rings 33 causes the diameter of the c-shaped ring(s) 31 to decrease so that the inner surface 31*c* of the c-shaped ring(s) 31 grips a portion of the mandrel section 14. The axial movement of the mandrel section 14 from the pulling action of the running tool 60 also causes the flow sub 36 and its components to press against the force of the biasing device 55 located between the cross over sub 30 and the lower collet expander 28, so that the protruding lip 30*d* of the cross over sub 30 engages with the hook portion 40 of the lower collet expander 28, as shown in FIG. 18E. FIG. 18E also shows that the engaged cross over sub 30 and lower collet expander 28 combined with the pulling movement of the running tool 60 causes the lower collet expander 28 to engage the lugs 44 of lower collet 22 to expand the lugs 44 outward to the "expanded position" against the outer edge of the end 102 of the tubular 100. The engagement of the lower collet expander 28 with the lugs 44 of lower collet 22 maintains the abutting contact of shoulder 50 of the lugs 44 against the outer edge of the end 102 of the tubular 100.

In addition, further movement of the mandrel section 14 in the second direction causes the protruding portion(s) 24 of the mandrel section 14 to be engaged with the locking slips 18. Engagement of the protruding portion(s) 24 with the locking slips 18 presses the locking slips 18 radially outward so that the locking slips 18 protrude out of the openings 16 in the body section 12. The protruding locking slips 18 press the radially extending protrusion 53 against an inner surface of the tubular 100 to grip the inner surface of the tubular 100. With the "mule shoe" bottom end 102 of tubular 100, the lower collet 22 may rotate about the axis of the end of tubing carrier tool 10 as the shoulder 50 of the lugs 44 slide along the "mule shoe" bottom end 102 until the grip of radially extending protrusion 53 against the inner surface of the tubular 100 prevents further movement of the body section 12 in the second direction. In this position, the end of tubing carrier tool 10 is releasably locked to the outer edge of the end 102 of the tubular 100. Friction of the shoulder 50 of the lugs 44 against the end 102 of the tubular 100 also contributes to the releasable lock of the end of tubing carrier tool 10 to the outer edge of the end 102 of the tubular 100.

Next, the running tool 60 is detached from the end of tubing carrier tool 10, which is locked to the end 102 of the tubular 100, by continued pulling of the running tool 60 that breaks the shear pin 62 of the flow collet 38 and the shear screws or pins 30*g* of the cross over sub 30 that hold the end of tubing carrier tool 10 on the running tool 60 (see FIG. 10B). Breaking the shear screws or pins 30*g* of the cross over sub 30 allows the flow collet 38 to slide within the flow sub 36 so that the hook part 42 of the flow collet 38 latches to the internal shoulder 36*e* of the flow sub 36. As discussed above, the new position of the flow collet 38 causes the sealing portion 64 of the flow collet 38 to block off the fluid flow ports 36*c* of the flow sub 36 to prevent fluid flow through the fluid flow ports 36*c*. Further pulling of the running tool 60 breaks the shear pin 62 that attaches the flow collet 38 to a distal end of a running tool 60 (see FIG. 17A), so that the running tool 60 is completely released from the end of tubing carrier tool 10. The running tool 60 may then be withdrawn from the tubular 100.

FIGS. 19A and 19B illustrate the process for releasing the end of tubing carrier tool 10 from being locked at the outer edge of the end 102 of the tubular 100. To begin with, a retrieving tool 70 is attached to the proximal end of the recovery sub 15 of the body section 12, via locking dogs 71. A downward jarring force is applied to the retrieving tool 70, or to the string having the retrieving tool 70, until the jarring force breaks the breakable attachment between the shear ring 23 and the mandrel section 14. Breaking the attachment between the shear ring 23 and the mandrel section 14 causes the mandrel section 14 to move in the first direction (downward) relative to the body section 12 by virtue of the weight of the mandrel section 14 and any downhole tool (such as a sand screen) attached to the mandrel section 14. The downward movement of the mandrel section 14 releases the compression force of the biasing device 34, which releases the force on the compression rings 33 so that the upward axial force from the compression rings 33 on the c-shaped ring(s) 31 of the mandrel locking ring(s) 26 is removed. The previously decreased inner diameter of the c-shaped ring thus increases back to its initial size before the c-shaped ring(s) 31 was compressed by the compression rings 33, so that the grip of the mandrel locking ring(s) 26 on the mandrel section 14 is released. In addition, the downward movement of the mandrel section 14 releases the engagement of the protruding portion(s) 24 of the mandrel section 14 with the locking slips 18, so that locking slips 18 retract back into the openings 16 of the body section 12. This retraction releases the grip of the radially extending protrusion 53 of the locking slips 18 against an inner surface of the tubular 100. Furthermore, downward movement of the mandrel section 14 relative to the body section 12 releases the engagement of the lower collet expander 28 with the lower collet 22, as shown in FIGS. 16A and 16B, such that the lugs 44 of the lower collet 22 retract from the "expanded position" discussed above. The retracted lugs 44 are thus free to fit back inside the tubular 100 for withdrawal of the end of tubing carrier tool 10 from the tubular 100, by virtue of the flexible prongs 22*a* of the lower collet 22, as shown in FIGS. 16A and 16B. With disengagement of the shear ring 23 to the mandrel section 14, release of the grip of the mandrel locking ring(s) 26 on the mandrel section 14, disengagement of the protruding portion(s) 24 of the mandrel section 14 with the locking slips 18, and disengagement of the lower collet expander 28 with the lower collet 22, the end of tubing carrier tool 10 can thus be withdrawn, via the attached retrieving tool 70, from the tubular 100 in the second direction towards the surface of the wellbore.

If, when attempting to remove the end of tubing carrier tool 10 from the tubular 100, the downhole tool (such as a sand screen) is not retrievable through the tubular 100, the retrieval process may further comprise applying an additional downward jarring force to the end of tubing carrier tool 10 (e.g., via the retrieving tool 70, or to the string having the retrieving tool 70) until the downward jarring force breaks the shear screws or pins 52, or other types of breakable elements, to release the breakable attachment between the lower retrieving sub 32 and the flow sub 36. The downhole tool attached to the lower retrieving sub 32 may remain in the wellbore while the end of tubing carrier tool 10 without the lower retrieving sub 32 is withdrawn from the tubular 100 in a direction towards the surface of the wellbore.

As discussed above, FIG. 14 illustrates an embodiment of a retrieving tool 70 for use with the end of tubing carrier tool 10. The retrieving tool 70 includes locking dogs 71 for attaching the retrieving tool 70 to the recovery sub 15 of the body section 12.

A benefit of the end of tubing carrier tool 10 disclosed herein is that the tool may be mechanically set, as opposed to being electronically set, such as with many unsuccessful and costly conventional methods. Moreover, the end of tubing carrier tool 10 can be mechanically set and/or recovered with one of several through tubing methods, such as, but not limited to, via slick-line, swabbing Cable, thru-tubing tubing, or sucker rods.

A method for releasably locking an end of tubing carrier tool 10 to an end 102 of a tubular 100 as discussed herein may include inserting, in a first direction, the end of tubing carrier tool 10 through the tubular 100 so that at least a lower collet 22 and a lower collet expander 28 of the end of tubing carrier tool 10 protrude out of the tubular 100 and beyond the end 102. The lower collet 22 may include lugs 44 as discussed herein. The method may include moving a mandrel section 14 of the end of tubing carrier tool 10 in a second direction that is opposite to the first direction to bring the lower collet expander 28 into engagement with the lower collet 22 to move the lugs 44 of the lower collet 22 radially outward to press against an exterior surface of the end 102 of the tubular 100 and releasably lock the end of tubing carrier tool 10 at the end 102 of the tubular 100.

The method may further include moving the mandrel section 14 in the second direction releasably locks the mandrel section 14 to a body section 12 of the end of tubing carrier tool 10 by engaging threads on an outer portion of the mandrel section 14 with threads on an inner portion of a threaded shear ring 23 on the body section 12 as discussed herein. Engagement of the mandrel section 14 with the threaded shear ring 23 prevents further movement of the mandrel section 14 in the second direction, as discussed herein. Moving the mandrel section 14 in the second direction causes a biasing device 34 of the body section 12 to be compressed and exert a force against an upper sub 29 adjacent the threaded shear ring 23 and on a mandrel locking ring 26, as discussed herein. The force reduces a diameter of the mandrel locking ring 26 so that the mandrel locking ring 26 grips a portion of the mandrel section 14 to releasably lock the mandrel section 14 to a body section 12; or increases a diameter of the mandrel locking ring 26 so that the mandrel locking ring 26 grips a portion of the body section 12 to releasably lock the mandrel section 14 to the body section 12, as discussed herein.

Moving the mandrel section 14 in the second direction causes a protruding portion 24 of the mandrel section 14 to engage and move one or more locking slips 18 of the body section 12 through a plurality of corresponding openings 16 in the body section 12 so that at least one radially extending protrusion 53 on each of the one or more locking slips 18 is pressed outward against an inner surface of the tubular 100 to releasably lock the end of tubing carrier tool 10 to an inside surface of the tubular 100, as discussed herein. As also discussed herein, the mandrel section 14 is moved in the second direction via a running tool 60 arranged inside of the mandrel section 14 and releasably attached to the end of tubing carrier tool 10 via one or more shear devices, and the running tool 60 is detached from the end of tubing carrier tool 10 via a force that breaks the one or more shear devices allowing for the running tool 60 to be removed from the tubular 100. The end of tubing carrier tool 10 may comprise a flow collet 38 contained within a flow sub 36 that includes a fluid flow port 36*c*, as discussed herein. The running tool 60 is detachably attached to the flow collet 38 by means of one or more shear devices 30*g*. 62, and continued movement in the second direction moves the flow collet 38 relative to the flow sub 36 to close the fluid flow ports 36*c*, as discussed herein. Further movement in the second direction breaks the one or more shear devices 30*g*, 62 to release the attachment of the running tool 60 to the flow collet 38 as discussed herein.

The method may further include producing a force via a retrieving tool on the end of tubing carrier tool 10 in the first direction and/or the second direction to break the engagement between the threaded shear ring 23 and the mandrel section 14 and cause the mandrel section 14 to move relative to the body section 12 in the first direction, as discussed herein. Movement of the mandrel section 14 relative to the body section 12 in the first direction disengages the collet expander 28 from the lower collet 22, which allows the lugs 44 of the lower collet 22 to flex radially inward and move out of contact with the exterior surface of the end 102 of the tubular 100, as discussed herein. The force on the end of tubing carrier tool 10 in the first direction or the second direction breaks one or more shear devices attaching a lower internal retrieving attachment 32 to a flow sub 36, and the lower internal retrieving attachment 32 may be for attaching to a downhole tool, as discussed herein. Movement of the mandrel section 14 to move relative to the body section 12 in the first direction causes the protruding portion 24 of the mandrel section 14 to disengage from the one or more locking slips so that the at least one radially extending protrusion 53 of each locking slip 18 is released from being pressed against the inner surface of the tubular 100, as discussed herein. Movement of the mandrel section 14 to move relative to the body section 12 in the first direction removes the force of the biasing device 34 on the mandrel locking ring 26 to further allow the diameter of the mandrel locking ring 26 to one of: increase and un-grip from the mandrel section 14; and decrease and un-grip from the body section 12, as discussed herein. The method may further include withdrawing the end of tubing carrier tool 10 from the tubular 100 in the second direction.

While various embodiments usable within the scope of the present disclosure have been described with emphasis, it should be understood that within the scope of the appended claims, the present invention may be practiced other than as specifically described herein.

What is claimed is:

1. An end of tubing carrier tool for running through and attaching to the end of a tubular, comprising:

a body section;

a lower collet on a distal portion of the body section, the lower collet including lugs for contacting an exterior surface of the end of the tubular;

a lower collet expander for expanding the lower collet; and a mandrel section arranged movably within and releasably lockable to the body section, and configured to move the lower collet expander into engagement with the lower collet, wherein engagement of the lower collet expander with the lower collet moves the lugs of the lower collet radially outward to press against the exterior surface of the end of the tubular and releasably lock the end of tubing carrier tool at the end of the tubular.

2. The end of tubing carrier tool according to claim 1, wherein each of the lugs comprises:

an angled outside surface at a tip of each lug to guide the end of tubing carrier tool into the tubular, and a shoulder to locate the exterior surface of the end of the tubular and sit on the exterior surface when the end of tubing carrier tool is set at the end of the tubular, wherein the shoulder is angled to guide the end of tubing carrier tool up the tubular.

3. The end of tubing carrier tool according to claim 2, wherein the lower collet comprises a plurality of prongs, wherein a distal end of each prong includes one of the lugs, and wherein the plurality of prongs is configured to flex radially inward or outward when the mandrel section moves relative to the body section and the collet expander engages or disengages the lugs.

4. The end of tubing carrier tool according to claim 1, wherein each of the lugs comprises an inner indentation that contacts a corresponding outer indentation on the lower collet expander, and the inner indentation and the outer indentation each comprises a contact surface that is perpendicular to a longitudinal axis of the end of tubing carrier tool.

5. The end of tubing carrier tool according to claim 1, wherein the lower collet expander comprises a plurality of axial extensions, each axial extension includes a hook portion at a distal end thereof, and the hook portion includes first contact surface.

6. The end of tubing carrier tool according to claim 5, further comprising a cross over sub for engaging with the lower collet expander via movement of the mandrel section, wherein the cross over sub is attached to the distal end of the mandrel section and comprises a protruding lip having a second contact surface that engages with the first contact surface of the hook portion when the mandrel section moves relative to the body section, and wherein the first contact surface and the second contact surface are at an angle other than 90 degrees relative to a longitudinal axis of the end of tubing carrier tool.

7. The end of tubing carrier tool according to claim 6, wherein an inner surface of the shear ring comprises a latch-and-lock mechanism, and comprises a longitudinal gap in a wall of the shear ring.

8. The end of tubing carrier tool according to claim 6, further comprising:

a flow sub coupled to the cross over sub; and a flow collet slidable within the flow sub and comprising a sealing portion, wherein the flow sub comprises a fluid flow port, and the sealing portion is configured to close the fluid flow port when the flow collet slides within the flow sub.

9. The end of tubing carrier tool according to claim 8, wherein at least one of the flow sub and the flow collet includes shear pins for attaching the end of tubing carrier tool to a running tool that runs the end of tubing carrier tool into the tubular and to the exterior surface of the bottom end of the tubular.

10. The end of tubing carrier tool according to claim 8, further comprising a lower internal retrieving attachment for attaching to a downhole tool, wherein the lower internal retrieving attachment is releasably coupled to the a distal end of the flow sub.

11. The end of tubing carrier tool according to claim 1, further comprising a shear ring on a proximal portion of the body section, wherein the shear ring is releasably attachable to the mandrel section via movement of the mandrel section relative to the body section, and wherein engagement of the mandrel section with the shear ring releasably locks the mandrel section to the body section.

12. The end of tubing carrier tool according to claim 1, wherein the body section further includes a plurality of openings spaced circumferentially from each other, and the end of tubing carrier tool further comprises:

a locking slip positioned at each one of the plurality of openings, wherein the mandrel section includes a protruding portion for engaging the locking slips, and each of the locking slips comprises at least one radially extending protrusion that extends through a respective one of the plurality of openings upon engagement of the protruding portion against the locking slips when the mandrel section moves relative to the body section, to press the at least one radially extending protrusion against an inner surface of the tubular to releasably lock the end of tubing carrier tool to the tubular.

13. The end of tubing carrier tool according to claim 1, wherein the body section further includes:

at least one mandrel locking ring for gripping a portion of the mandrel section to releasably lock the mandrel section to the body section; and a biasing device for actuating the mandrel locking ring.

14. The end of tubing carrier tool according to claim 13, wherein the mandrel locking ring comprises a c-shaped ring positioned between two pressure rings that transmit a compression force from the biasing device to the c-shaped ring, and a diameter of the c-shaped ring decreases or increases via the compression force so that the c-shaped ring grips the portion of the mandrel section when the diameter decreases and grips a portion of the body section when the diameter increases.

15. The end of tubing carrier tool according to claim 14, wherein the c-shaped ring comprises at least one of:

an inner surface that faces the portion of the mandrel section, and the inner surface comprises a plurality of axially extending recesses; and an outer surface that faces the body section, and the outer surface comprises a plurality of axially extending recesses.

16. A method for releasably locking an end of tubing carrier tool to an end of a tubular, comprising:

inserting, in a first direction, the end of tubing carrier tool through the tubular so that at least a lower collet and a lower collet expander of the end of tubing carrier tool protrude out of the tubular and beyond the end, the lower collet including lugs; and moving a mandrel section of the end of tubing carrier tool in a second direction that is opposite to the first direction to bring the lower collet expander into engagement with the lower collet to move the lugs of the lower collet radially outward to press against an exterior surface of the end of the tubular and releasably lock the end of tubing carrier tool at the end of the tubular.

17. The method according to claim 16, wherein moving the mandrel section in the second direction releasably locks the mandrel section to a body section of the end of tubing carrier tool by engaging an outer portion of the mandrel section with an inner portion of a shear ring on the body section, wherein engagement of the mandrel section with the shear ring prevents further movement of the mandrel section in the second direction.

18. The method according to claim 17, wherein moving the mandrel section in the second direction causes a biasing device of the body section to be compressed and exert a force against an upper sub adjacent the shear ring and on a mandrel locking ring, wherein the force:

reduces a diameter of the mandrel locking ring so that the mandrel locking ring grips a portion of the mandrel section to releasably lock the mandrel section to a body section; or increases a diameter of the mandrel locking ring so that the mandrel locking ring grips a portion of the body section to releasably lock the mandrel section to the body section.

19. The method according to claim 18, further comprising;

producing a force via a retrieving tool on the end of tubing carrier tool in the first direction and/or the second direction to break the engagement between the shear ring and the mandrel section and cause the mandrel section to move relative to the body section in the first direction, wherein movement of the mandrel section relative to the body section in the first direction disengages the collet expander from the lower collet, which allows the lugs of the lower collet to flex radially inward and move out of contact with the exterior surface of the end of the tubular.

20. The method according to claim 19, wherein the force on the end of tubing carrier tool in the first direction or the second direction breaks one or more shear devices attaching a lower internal retrieving attachment to a flow sub, the lower internal retrieving attachment for attaching to a downhole tool.

21. The method according to claim 19, wherein movement of the mandrel section to move relative to the body section in the first direction causes the protruding portion of the mandrel section to disengage from the one or more locking slips so that the at least one radially extending protrusion of each locking slip is released from being pressed against the inner surface of the tubular.

22. The method according to claim 21, wherein movement of the mandrel section to move relative to the body section in the first direction removes the force of the biasing device on the mandrel locking ring to further allow the diameter of the mandrel locking ring to one of: increase and un-grip from the mandrel section; and decrease and un-grip from the body section.

23. The method according to claim 22, further comprising:

withdrawing the end of tubing carrier tool from the tubular in the second direction.

24. The method according to claim 16, wherein moving the mandrel section in the second direction causes a protruding portion of the mandrel section to engage and move one or more locking slips of the body section through a plurality of corresponding openings in the body section so that at least one radially extending protrusion on each of the one or more locking slips is pressed outward against an inner surface of the tubular to releasably lock the end of tubing carrier tool to an inside surface of the tubular.

25. The method according to claim 16, wherein the mandrel section is moved in the second direction via a running tool arranged inside of the mandrel section and releasably attached to the end of tubing carrier tool via one or more shear devices, and the running tool is detached from the end of tubing carrier tool via a force that breaks the one or more shear devices allowing for the running tool to be removed from the tubular.

26. The method according to claim 25, wherein the end of tubing carrier tool comprises a flow collet contained within a flow sub that includes a fluid flow port, the running tool is detachably attached to the flow collet by means of one or more shear devices, and continued movement in the second direction moves the flow collet relative to the flow sub to close the fluid flow ports, and wherein further movement in the second direction breaks the one or more shear devices to release the attachment of the running tool to the flow collet.

27. A system for releasably locking an end of tubing carrier tool to an end of a tubular, comprising:

an end of tubing carrier tool for insertion into the tubular, the end of tubing carrier tool configured to be releasably locked to an exterior surface of the end of the tubular;

a running tool for running the end of tubing carrier tool into the tubular and releasably attaching the end of tubing carrier tool to the exterior surface of the end of the tubular, the running tool configured to be releasably attached to the end of tubing carrier tool;

a first jarring tool for attaching to the running tool and for producing a jarring force to release the attachment of the running tool with the end of tubing carrier tool, and for withdrawing the running tool from the tubular;

a retrieving tool for releasably attaching to the an end of tubing carrier tool at the exterior surface of the end of the tubular; and a second jarring tool for attaching to the retrieving tool and for producing a jarring force to release the attachment of the end of tubing carrier tool from the exterior surface of the end of the tubular.

* * * * *